US010422114B2

(12) United States Patent
Nahum

(10) Patent No.: US 10,422,114 B2
(45) Date of Patent: Sep. 24, 2019

(54) SINK DRAIN WITH INTEGRATED TRAP AND REMOVABLE LOWER COVER

(71) Applicant: Nir Nahum, Even Shmuel (IL)

(72) Inventor: Nir Nahum, Even Shmuel (IL)

(73) Assignee: NIR PRACTICAL SOLUTIONS LTD, Even Shmuel (IL)

( * ) Notice: Subject to any disclaimer, the term of this patent is extended or adjusted under 35 U.S.C. 154(b) by 0 days.

(21) Appl. No.: 15/814,953

(22) Filed: Nov. 16, 2017

(65) Prior Publication Data

US 2018/0073229 A1 Mar. 15, 2018

Related U.S. Application Data

(63) Continuation-in-part of application No. PCT/IB2016/052853, filed on May 17, 2016.
(Continued)

(51) Int. Cl.
*E03C 1/282* (2006.01)
*E03C 1/22* (2006.01)
(Continued)

(52) U.S. Cl.
CPC ..... *E03C 1/282* (2013.01); *E03C 1/1222* (2013.01); *E03C 1/22* (2013.01); *E03C 1/29* (2013.01); *E03C 1/30* (2013.01); *E03C 1/26* (2013.01)

(58) Field of Classification Search
CPC . E03C 1/28; E03C 1/182; E03C 1/122; E03C 1/1222; E03C 1/26; E03C 1/29; E03C 1/30
(Continued)

(56) References Cited

U.S. PATENT DOCUMENTS 4,263,934 A * 4/1981 Redden ..... A61C 17/046 137/140
4,516,278 A 5/1985 Lamond
(Continued)

FOREIGN PATENT DOCUMENTS

AU 4014568 A 1/1971
DE 1409730 A1 4/1969
(Continued)

OTHER PUBLICATIONS

Machine Translation (by EPO and Google) for DE1409730 published on Apr. 30, 1969.
(Continued)

*Primary Examiner* — Huyen D Le
(74) *Attorney, Agent, or Firm* — Marc Van Dyke; Fourth Dimension IP

(57) ABSTRACT

A drain assembly for a sink has an abutment surface (14) for abutting an underside of the sink around the drain aperture, and a first wall portion (16) circumscribing an upper drain volume (18). A down-flow conduit (20) and an up-flow conduit (24) are delineated by a second and third wall portions (22, 26), one of which has an edge defining a lip (28) between the down-flow conduit (20) and up-flow conduit (24). An outlet (30) is connected to up-flow conduit (24). A removable lower cover (32) attaches to the wall portions so as to complete a flow path from the down-flow conduit (20) to the up-flow conduit (24) so as to form a trap. At least the first, second and third wall portions (16, 22, 26) and the outlet (30) are integrally formed as a unitary body, most preferably by an injection molding process.

20 Claims, 17 Drawing Sheets

Related U.S. Application Data

(60) Provisional application No. 62/162,754, filed on May 17, 2015.

(51) Int. Cl.
*E03C 1/29* (2006.01)
*E03C 1/122* (2006.01)
*E03C 1/30* (2006.01)
*E03C 1/26* (2006.01)

(58) Field of Classification Search
USPC ..... 4/679
See application file for complete search history.

(56) References Cited

U.S. PATENT DOCUMENTS 5,063,616 A 11/1991 Bresnahan
7,155,760 B2 * 1/2007 McAlpine ..... E03C 1/29 137/247.35
2009/0308463 A1 * 12/2009 Bacon ..... E03C 1/29 137/247
2011/0036417 A1 * 2/2011 McAlpine ..... E03C 1/29 137/247.13
2012/0167296 A1 * 7/2012 Nomura ..... E03C 1/281 4/311

FOREIGN PATENT DOCUMENTS

FR 262299 A1 12/1993
GB 796324 A 6/1958
GB 999547 A 7/1965

OTHER PUBLICATIONS

Machine Translation (by EPO and Google) for FR262299 published on Dec. 17, 1993.
International Search Report for PCT/1132016/052853 dated Oct. 13, 2016.
Written Opinion for PCT/IB2016/052853 dated Oct. 13, 2016.

* cited by examiner

SINK DRAIN WITH INTEGRATED TRAP AND REMOVABLE LOWER COVER

RELATED APPLICATIONS

The present application is a continuation-in-part (CIP) of PCT/IB2016/052853 filed on or around May 17, 2016 which published as WO/2016/185375 and which is incorporated herein by reference in its entirety.

FIELD AND BACKGROUND OF THE INVENTION

The present invention relates to sink drains and, in particular, it concerns a sink drain which integrates a gas trap, and optionally also a waste collection volume and a removable lower cover.

Drainage installations for sinks typically include a number of distinct structures performing a number of distinct functions, as illustrated with reference to an under-sink assembly 100 shown in FIG. 12. A sink drain assembly 125 connects to the aperture of a sink (not shown), and typically includes a strainer including a grating or sieve for preventing passage of waste, which may include hair and objects above a given size. Particularly for kitchen sinks, the waste collection volume may be of relatively large diameter and depth, and typically has a removable "basket strainer" 170 in which waste collects until the strainer is intermittently removed and emptied. The sink drain assembly is typically connected to a pipe or "tailpiece" 120 by a connector, such as by a nut 140.

A further requirement of under-sink plumbing installations is a "trap" 130, also referred to as a "gas trap" or "siphon", which traps a quantity of water by gravity so as to block escape of noxious sewer gases and odors up through the pipes to the sink. Traps can be implemented using S-bend or P-bend curved pipe sections, or as shown in FIG. 12, using a compact "bottle trap" assembly. The trap must be connected to tailpiece 120, such as at seal 150, and provides an outlet which must also be connected to a pipe (not shown) via a connector, such as nut 160, to connect the outlet of the trap to the wastewater drainage system. In many cases, one or more additional branch tube (not shown) is connected between the tailpiece and the trap in order to allow connection of a sink overflow drain and/or an outlet of an appliance, such as a dishwasher. In many cases, the number of components and complexity of the arrangement is much greater than illustrated here.

The above typical arrangement requires assembly of multiple components with a corresponding number of joints, each with potential for developing a leak. Furthermore, the entire assembly occupies a considerable volume, and in particular, dictates a minimum vertical height of the assembly beneath the sink, thereby limiting usage of the under-sink space and rendering installation problematic in various space-limited scenarios.

SUMMARY OF THE INVENTION

The present invention is a sink drain apparatus that integrates a waste collection volume with a gas trap.

According to the teachings of the present invention there is provided, an apparatus for connection to a drain aperture of a sink, the apparatus comprising: (a) an abutment surface for abutting an underside of the sink around the drain aperture; (b) a first wall portion extending downwards from the abutment surface, the first wall portion circumscribing an upper drain volume; (c) a down-flow conduit delineated at least in part by a second wall portion, the down-flow conduit being in fluid connection with, and extending downwards from, the upper drain volume; (d) an up-flow conduit delineated at least in part by a third wall portion, wherein either the second wall portion or the third wall portion has an edge defining a lip between the down-flow conduit and the up-flow conduit; (e) an outlet in fluid connection with the up-flow conduit; and (f) a removable lower cover configured for sealed connection with at least one of the second wall portion and the third wall portion so as to complete a flow path from the down-flow conduit to the up-flow conduit such that a height differential between the lip and the outlet defines a trap, wherein at least the first wall portion, the second wall portion, the third wall portion and the outlet are integrally formed as a unitary body.

According to a further feature of an embodiment of the present invention, the unitary body terminates at a threaded lower opening, and wherein the removable lower cover if formed with a complementary threaded rim for threaded attachment to and removal from the unitary body.

According to a further feature of an embodiment of the present invention, the first wall portion comprises a cylindrical wall portion circumscribing the upper drain volume, and wherein the cylindrical wall portion has a first cross-sectional area greater than an internal cross-sectional area of each of the down-flow conduit and the up-flow conduit adjacent to the lip, the upper drain volume for receiving a removable basket strainer for waste collection.

According to a further feature of an embodiment of the present invention, the first wall portion circumscribes the upper drain volume so as to provide an unobstructed depth of at least 2 centimeters extending downwards from the abutment surface for receiving a removable basket strainer for waste collection.

According to a further feature of an embodiment of the present invention, there is also provided a clamping block having a threaded aperture, the clamping block being supported at the base of the upper drain volume for bolted attachment to an upper drain cup.

According to a further feature of an embodiment of the present invention, there is also provided a clamping block adapter having a male threaded portion for engaging the threaded aperture and a threaded aperture for bolted attachment to a shallow upper drain cup.

According to a further feature of an embodiment of the present invention, the abutment surface is integrally formed at an upper end of the first wall portion.

According to a further feature of an embodiment of the present invention, the down-flow conduit is implemented as an internal pipe circumscribed by the up-flow conduit.

According to a further feature of an embodiment of the present invention, the down-flow conduit and the up-flow conduit are in side-by-side relation with part of the second wall portion defining a partition between the down-flow conduit and the up-flow conduit.

According to a further feature of an embodiment of the present invention, there is also provided a supplementary inlet in flow connection with the down-flow conduit, the supplementary inlet being located above the lip by at least the height differential.

There is also provided according to the teachings of an embodiment of the present invention, an apparatus for connection to a drain aperture of a sink, the apparatus comprising: (a) an abutment surface for abutting an underside of the sink around the drain aperture; (b) an outer wall portion extending downwards from the abutment surface; (c)

a rim defining a lower opening; (d) an outlet; and (e) a removable lower cover configured for sealed connection with the rim, wherein at least the abutment surface, the outer wall portion, the rim and the outlet are integrally formed as a unitary body, and wherein, when assembled, the outer wall portion and the removable lower cover form at least part of an outer casing of a bottle trap preventing passage of gases from the outlet to the drain aperture.

There is further provided according to the teachings of an embodiment of the present invention a monolithic drain apparatus for connection to a drain aperture of a sink, the drain apparatus including:

a drain receptacle including a top opening adapted to align with the drain aperture of the sink, the top opening having a first diameter ($D_{top}$ or $D_t$) defining a first cross sectional area, a bottom opening enabling fluid to drain from the drain receptacle and having a second diameter ($D_{bottom}$ or $D_b$) defining a second cross-sectional area, the drain receptacle defining a drain volume ($V_{drain}$);

a drain apparatus housing connected to the drain receptacle, including:

a down-flow conduit extending from the drain receptacle in alignment with the bottom opening and having a down-flow conduit circumference, the down-flow conduit defining a down-flow-path in fluid communication with the drain volume; and an up-flow conduit, extending alongside the down-flow conduit and defining an up-flow-path; and a partition separating the down-flow conduit from the up-flow conduit;

an outlet drain pipe extending from the drain apparatus housing at a terminus of the up-flow conduit and defining an outlet-flow-path in fluid communication with the up-flow-path; and a reversibly removable lower cover configured to sealingly engage the drain apparatus housing, so as to complete a sealed flow path from the drain volume, via the down-flow-path, to the up-flow-path conduit and the outlet-flow-path, wherein a height differential ($h_d$) between a bottom of an interior wall of the outlet drain pipe and a bottom edge of the partition defines a (gas) trap, $h_d>0$, wherein a cross-sectional area of the down-flow conduit is at least 80% of the second cross-sectional area along the entire length of the down-flow conduit, wherein the drain receptacle, the drain apparatus housing including the partition, and the outlet drain pipe, are monolithic, and wherein a portion of the outlet drain pipe is disposed above the bottom opening of the drain receptacle by a height $h_o$, wherein $h_o$ is greater than 0.

In some embodiments, the cross-sectional area of the down-flow conduit is at least 85%, at least 90%, at least 95%, at least 100%, or at least 105% of the second cross-sectional area along the entire length of the down-flow conduit.

In some embodiments, a wall portion of the drain receptacle is a cylinder, and the portion of the outlet drain pipe is disposed above a bottom of the cylinder, by a height $h_{oc}$, where $h_{oc}$ is greater than 0.

In some embodiments, this cylinder has a height within a range of at least 2 cm, at least 3 cm, at least 4 cm, at least 5 cm, or at least 6 cm, and in some embodiments, within the range of 2-10 cm, 3-8 cm, 3-6 cm, 4-8 cm, 5-8 cm, or 6-8 cm.

In some embodiments, $h_{oc}$ is at least 0.5 cm, at least 1.0 cm, or at least 1.5 cm.

In some embodiments, $h_{oc}$ is within the range of 0.5 to 5 cm, 0.5 to 4 cm, 0.5 to 3 cm, 1 to 5 cm, 1 to 4 cm, 1 to 3 cm, 1.5 to 5 cm, 1.5 to 4 cm, or 1.5 to 3 cm.

In some embodiments, the outlet-flow-path is perpendicular to the up-flow-path.

In some embodiments, the drain receptacle has a depth ($h_r$) of at least 2 cm, at least 4 cm, at least 5 cm, at least 6 cm, or at least 7 cm.

In some embodiments, the drain receptacle has a depth ($h_r$) in the range of 2-10 cm, 4-10 cm, 5-10 cm, 6-10 cm, 7-10 cm, 4-9 cm, 5-9 cm, 6-9 cm, 4-8 cm, 5-8 cm, or 6-8 cm.

In some embodiments, the height differential ($h_d$) is at least 0.5 cm, at least 1 cm, at least 1.5 cm, at least 2 cm, or at least 3 cm.

In some embodiments, the height differential ($h_d$) is at most 8 cm, at most 7 cm, at most 6 cm, at most 5 cm, or at most 4 cm, and in some embodiments is within the range of 1 to 8 cm, 2 to 7 cm, 3 to 7 cm, 3.5 to 6 cm, or 3 to 6 cm.

In some embodiments, $h_o$ is at least 1.0 cm, at least 1.5 cm, at least 2.0 cm, or at least 2.5 cm.

In some embodiments, $h_o$ is within the range of 1 to 7 cm, 1 to 5 cm, 1.5 to 7 cm, 1.5 to 6 cm, 1.5 to 5 cm, 1.5 to 4 cm, 1.5 to 3.5 cm, 2 to 6 cm, 2 to 5 cm, or 2.5 to 5 cm.

In some embodiments, the partition blocks flow from the up-flow-path and the outlet drain pipe into the down-flow-path.

In some embodiments, the removable lower cover has a cross-sectional area which is substantially equal to the first cross sectional area, and the cover circumference and the first circumference are not concentric.

In some embodiments, the removable lower cover is offset relative to the drain receptacle.

In some embodiments, the length of the offset ($L_{offset}$) is at least 1 cm, at least 2 cm, at least 3 cm, or at least 4 cm. In some embodiments, the length of the offset ($L_{offset}$) is within a range of 1-10 cm, 1-8 cm, 1-6 cm, 2-10 cm, 2-8 cm, 2-6 cm, 3-10 cm, 3-8 cm, 3-6 cm, 4-10 cm, 4-8 cm, or 4-6 cm In some embodiments, the apparatus further includes an abutment surface, circumscribing the top opening of the drain receptacle, adapted to abut a surface of the sink surrounding the drain aperture.

In some embodiments, an annular wall extends from a bottom edge of the abutment surface to a top edge of the drain receptacle, the annular wall defining a seat for a sealing element.

In some embodiments, the apparatus further includes a drain cup adapted to be disposed in the drain volume and to serve as an inner liner of the drain receptacle. In some such embodiments, the apparatus further includes a clamping block including a threaded aperture for bolted attachment of the drain cup to the drain receptacle.

In some embodiments, the apparatus further includes a strainer adapted to be housed in the drain volume and to collect waste in the drain volume.

In some embodiments, the apparatus further includes an inlet defining an inlet-flow-path, the inlet-flow-path being in fluid communication with the down-flow-path, the inlet being disposed at least partially above the trap and being monolithic with the drain apparatus housing.

In some embodiments, a total height ($h_{total}$) of the drain apparatus, including the reversibly removable lower cover, is at most 20 cm, at most 18 cm, at most 17 cm, at most 16 cm, or at most 15 cm.

In some embodiments, a total height ($h_{total}$) of the drain apparatus, including the reversibly removable lower cover, is in the range of 12-20 cm, 14-20 cm, 15-20 cm, 12-18 cm, 13-18 cm, 14-18 cm, 12-17 cm, 13-17 cm, 14-17 cm, 15-17 cm, 12-16 cm, 13-16 cm, or 14-16 cm.

In some embodiments, a diameter of the top opening of the drain receptacle is in the range of 7-15 cm, 8-15 cm, or 8-12 cm.

In some embodiments, the drain apparatus housing has a thread on an exterior surface thereof distal from the drain receptacle, and the removable lower cover has a corresponding thread on an interior surface thereof for threaded attachment to and removal from the drain apparatus housing.

In some embodiments, the removable lower cover has a depth ($h_c$) so as to increase the total height of the apparatus by 1 to 5 cm, 1 to 4 cm, 1.5 to 5 cm, 1.5 to 4 cm, 1.5 to 3 cm, 2 to 5 cm, 2 to 4 cm, 2 to 3.5 cm, or 2 to 3 cm.

As used in the Description and Claims, the orientation of components (up, down, etc.) refers to the operating orientation, with the top opening of the drain receptacle substantially (within 10 degrees of, within 5 degrees of, and more typically, within 3 degrees of) horizontal.

As used in the Description and Claims, the term "A is substantially equal to B" relates to items A and B having at most 10% difference in dimension or magnitude, at most 5% difference, or at most 3% difference in dimension or magnitude.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a sink drain apparatus which integrates a gas trap, and optionally also a waste collection volume and a removable lower cover.

The principles and operation of an apparatus according to the present invention may be better understood with reference to the drawings and the accompanying description.

Figure 1A:
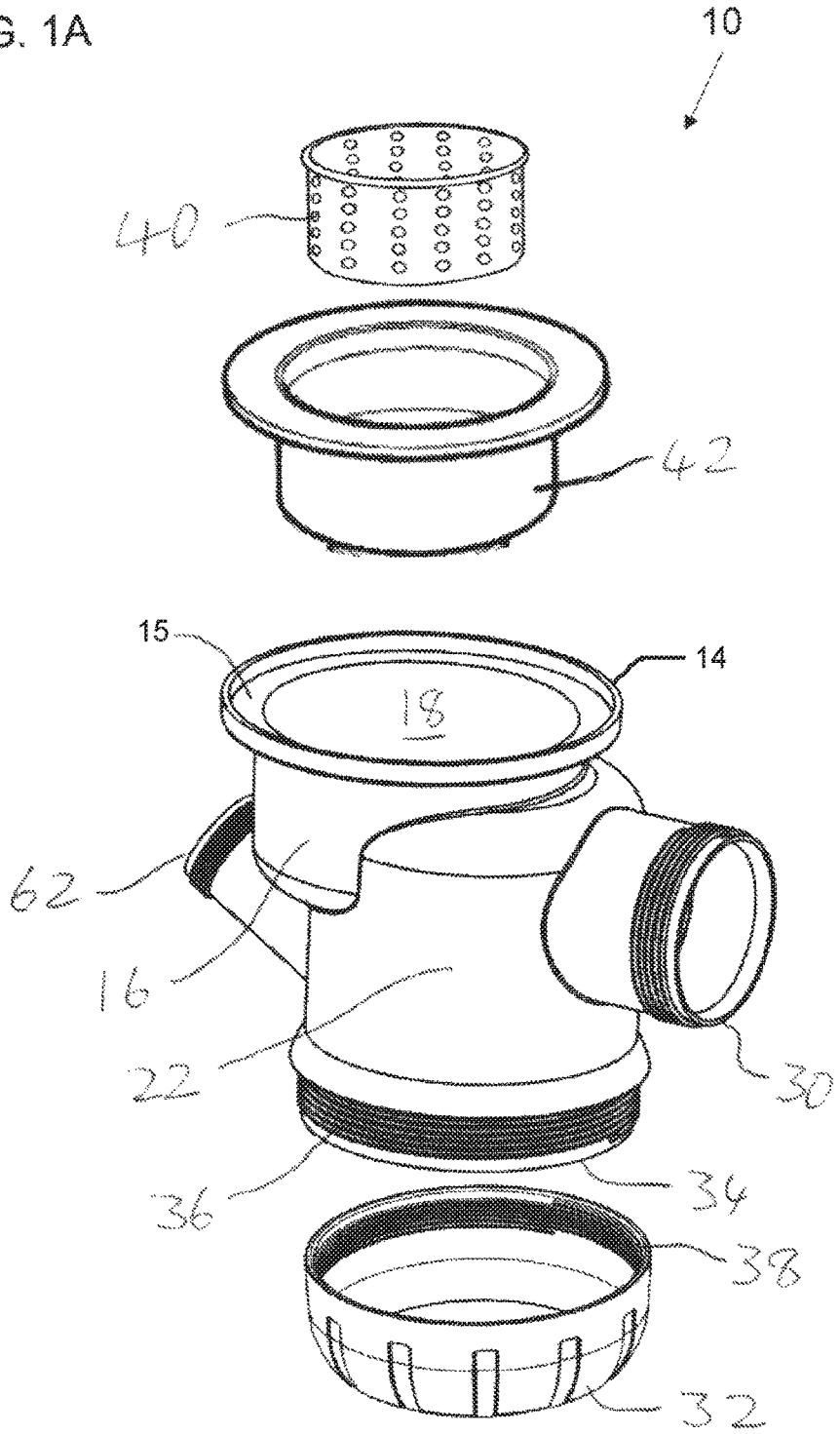
FIG. 1A is an exploded isometric view of a sink drain apparatus, constructed and operative according to an embodiment of the present invention, which integrates a gas trap, a waste collection volume and a removable lower cover.
Figure 1B:
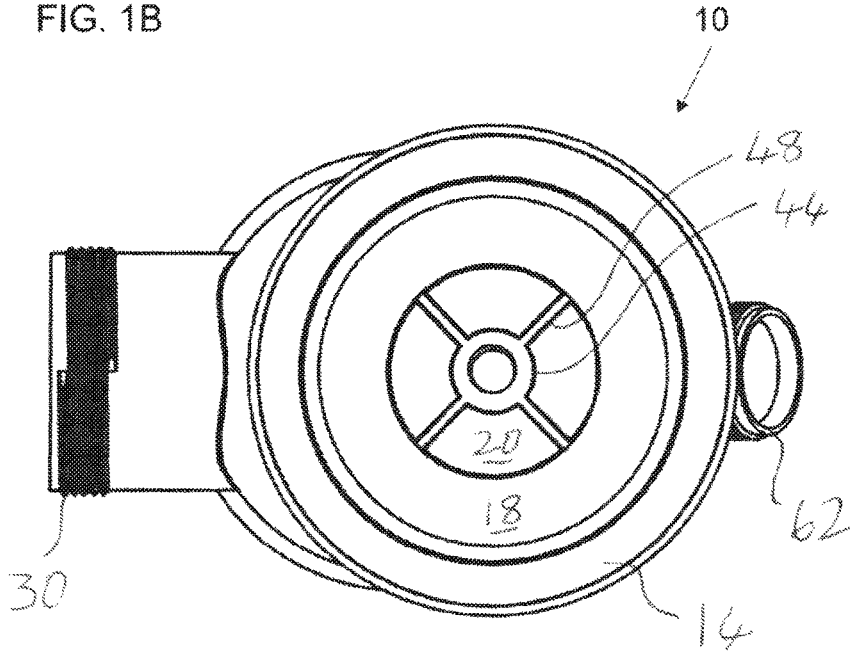
FIG. 1B is a top view of a unitary body from the apparatus of FIG. 1A.
Figure 1C:
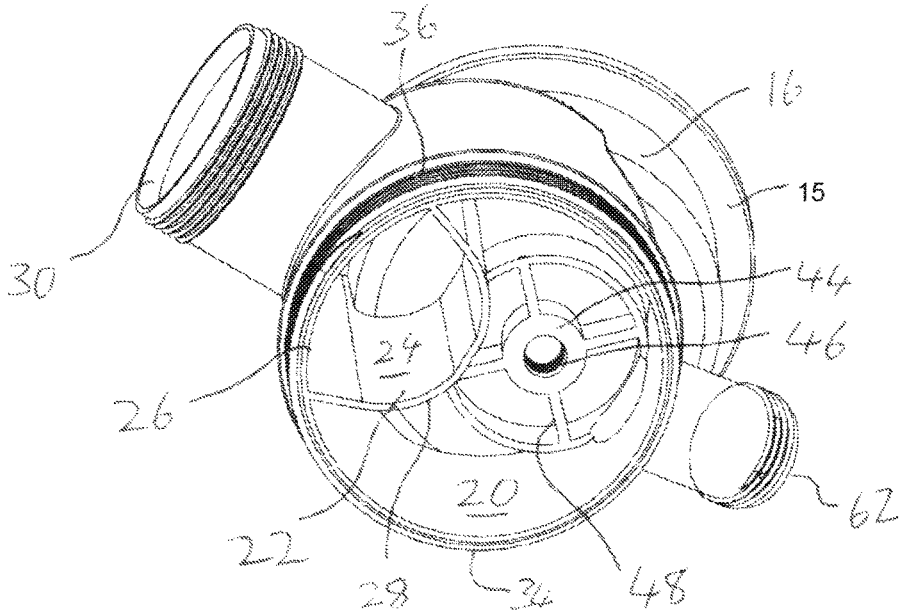
FIG. 1C is a lower isometric view of the unitary body from the apparatus of FIG. 1A.
Figure 1D:
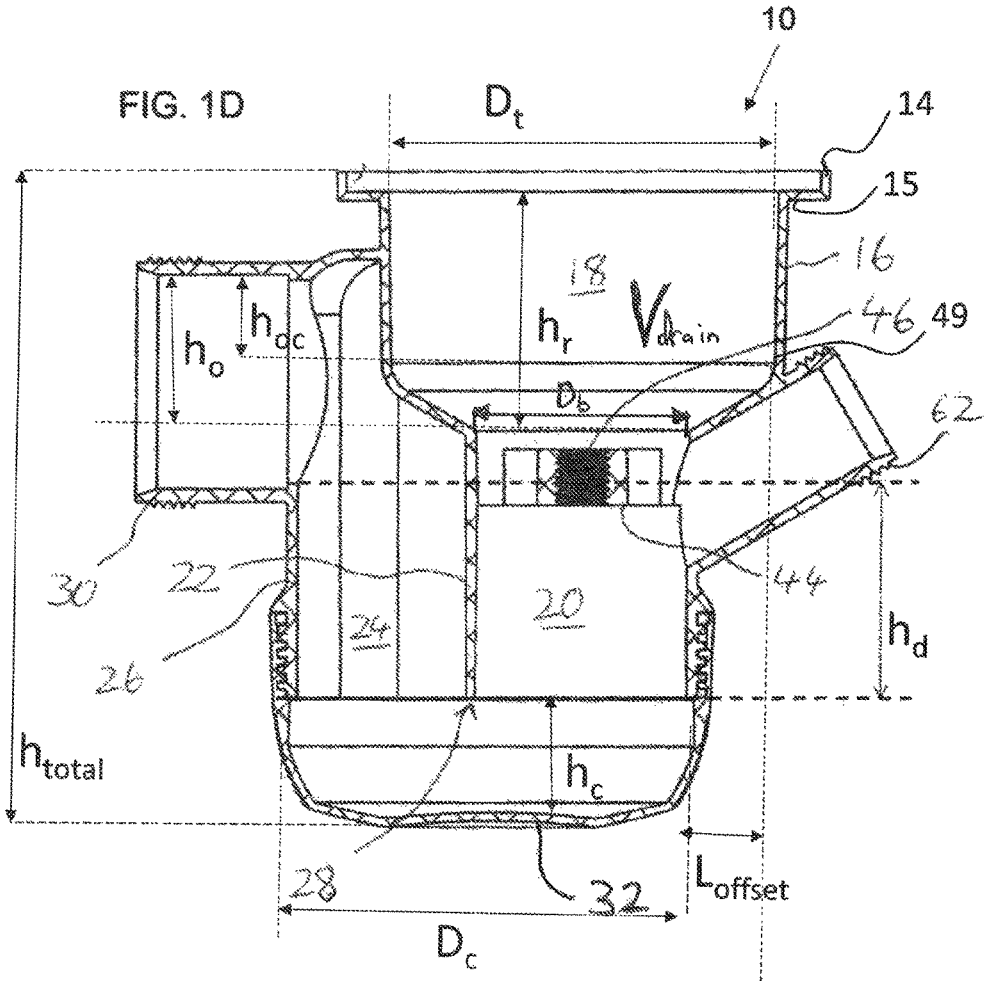
FIG. 1D is a vertical cross-sectional view taken through the unitary body from the apparatus of FIG. 1A.
Figure 2A:
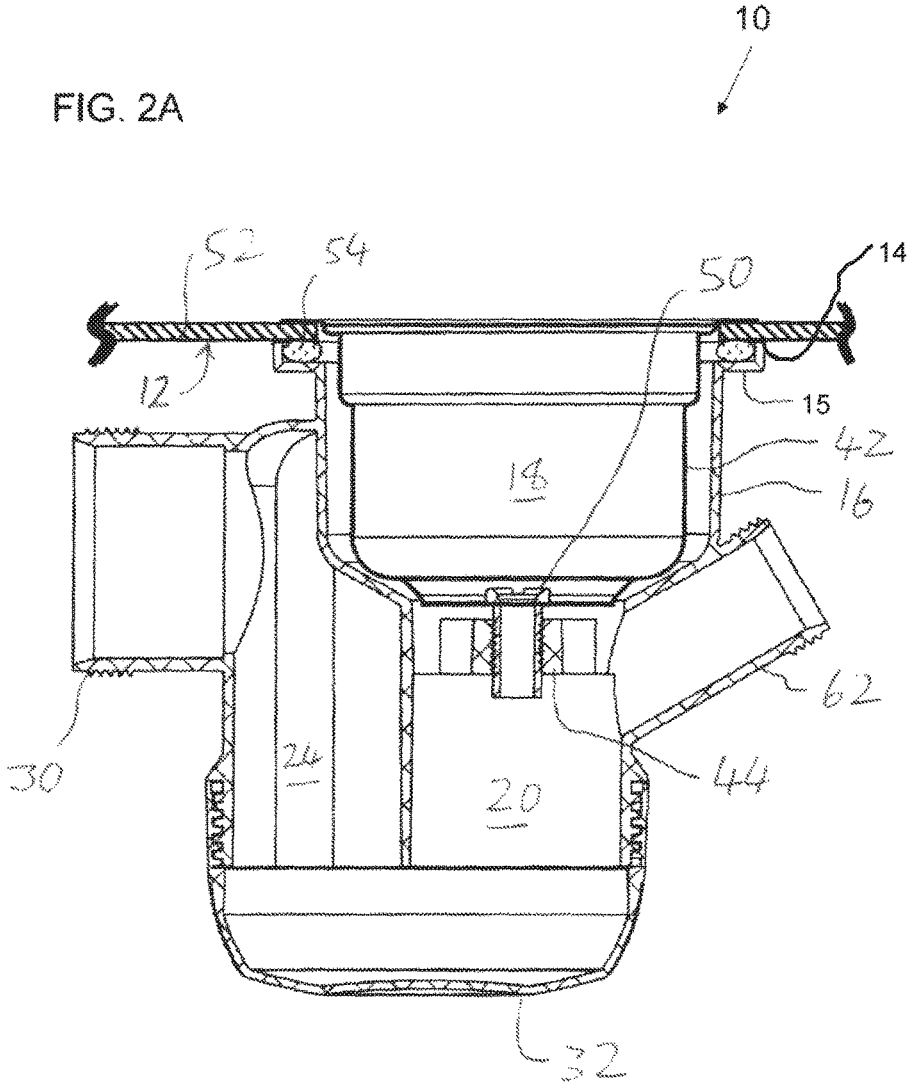
FIG. 2A is a cross-sectional view similar to FIG. 1D showing the apparatus assembled to the drain aperture of a sink.
Figure 2B:
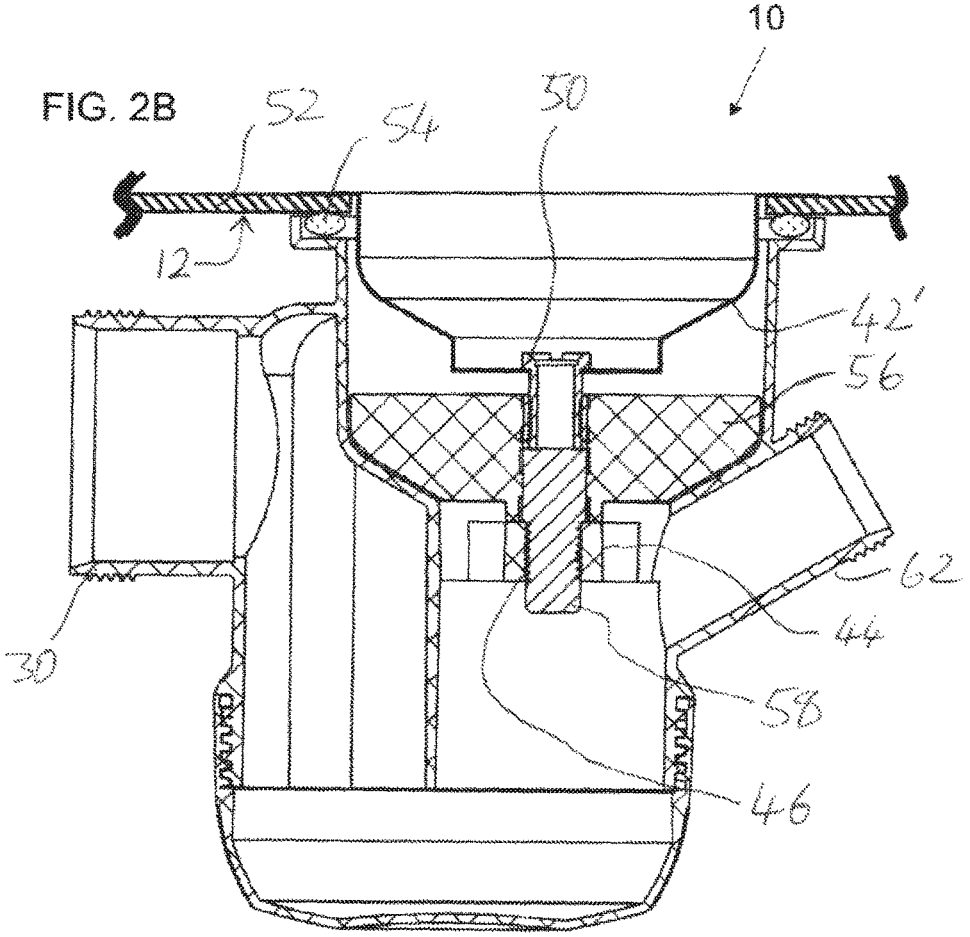
FIG. 2B is a view similar to FIG. 2A illustrating an assembly of the present invention employing a reduced-depth upper drain cup.
Figure 2C:
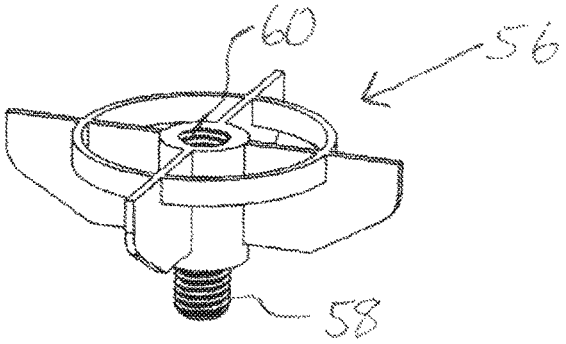
FIG. 2C is an isometric view of an adapter employed in the assembly of FIG. 2B.

Referring now to the drawings in general terms, and using terminology which will be preserved throughout the description, FIGS. 1A-11C show a number of variant implementations of an apparatus, designated 10, 200, 300, 400, 500, 600, 700, 800, 900 and 1000, for connection to a drain aperture of a sink (the bottom surface of which is designated 12 in FIGS. 2A and 2B). To avoid repeated description of equivalent components in the various implementations, similar reference numerals will be used throughout the description for analogous elements, with the hundreds digit of the embodiment reference numeral used as a prefix to the numeral. Thus, the description of the components of apparatus 10 below should be understood to also describe the corresponding components of apparatus 200, 300 etc. where, for example, element 14 will become 214, 314 etc., respectively, except where distinctions between the elements are explicitly specified or clearly required.

In general terms, the apparatus includes an abutment surface 14 for abutting an underside 12 of the sink around the drain aperture, and a first wall portion 16, defining a drain receptacle enclosing an upper drain volume 18, also indicated by $V_{drain}$. The first wall portion 16 includes an upper cylindrical portion, terminating at reference numeral 49, and a lower conical or substantially frusto-conical portion. The receptacle has a top opening in alignment with the drain aperture of the sink, and a bottom opening. An annular wall portion 15 connects a wall portion including abutment surface 14 to first wall portion 16 of the drain receptacle, and defines a seat for a sealing element, as shown in FIG. 2A.

A down-flow conduit 20, delineated at least in part by a second wall portion 22 extends downwards from the first wall portion 16 of the drain receptacle around the bottom opening thereof, and defines a down-flow-path in fluid communication with upper drain volume 18. A cross sectional area of the down-flow conduit is at least 80%, at least 90%, at least 95%, at least 100%, or at least 105% of the cross-sectional area of the bottom opening, along the entire length of the down-flow conduit.

An up-flow conduit 24 is delineated at least in part by a third wall portion, or partition, 26, and defines an up-flow-path, which is parallel to the down-flow-path. Second wall portion 22 (or in some cases third wall portion 26) has an edge defining a lip 28 between down-flow conduit 20 and up-flow conduit 24. An outlet 30 extends from up-flow conduit 24, such that an outlet-flow-path thereof is in fluid communication with the up-flow-path.

A removable lower cover 32 is configured for sealed connection with either or both of second wall portion 22 and third wall portion 26 so as to complete a flow path from down-flow conduit 20, via up-flow conduit 24 to outlet 30, such that a height differential $h_d$ between lip 28 and outlet 30 defines a trap. In some embodiments, the height differential $h_d$ ($h_d$=outlet height position−lip height position) is at most 8 cm, at most 7 cm, at most 6 cm, at most 5 cm, or at most 4 cm. In some embodiments, the height differential ($h_d$) is at least 0.5 cm, at least 1 cm, at least 1.5 cm, at least 2 cm, or at least 3 cm. In some embodiments, the height differential ($h_d$) is within the range of 1 to 8 cm, 2 to 7 cm, 3 to 7 cm, 3.5 to 6 cm, or 3 to 6 cm.

It is a particular feature of certain particularly preferred embodiments of the present invention that at least first wall portion 16, second wall portion 22, third wall portion 26 and outlet 30 are integrally formed as a unitary body, most preferably by an injection molding process. Abutment surface 14 is preferably also integrated with an upper part of the unitary body.

It is another feature of the present invention that an upper portion of outlet 30 is disposed above the bottom opening of the drain receptacle defined by first wall portion 16, such that there is an overlap between a height of the drain receptacle ($h_r$) and the top height position of the diameter of the outlet pipe, the overlap indicated by $h_o$ in FIG. 1D. In some embodiments, $h_o$ is at least 1.0 cm, at least 1.5 cm, at least 2.0 cm, or at least 2.5 cm. In some embodiments, $h_o$ is within the range of 1 to 7 cm, 1 to 5 cm, 1.5 to 7 cm, 1.5 to 6 cm, 1.5 to 5 cm, 1.5 to 4 cm, 1.5 to 3.5 cm, 2 to 6 cm, 2 to 5 cm, or 2.5 to 5 cm.

In some embodiments, the upper portion of outlet 30 is disposed above the bottom edge 49 of the cylindrical portion of the drain receptacle by a height of $h_{oc}$. In some embodiments the height $h_{oc}$ is greater than 0. In some embodiments, $h_{oc}$ is at least 0.5 cm, at least 1.0 cm, or at least 1.5 cm. In some embodiments, $h_{oc}$ is within the range of 0.5 to 5 cm, 0.5 to 4 cm, 0.5 to 3 cm, 1 to 5 cm, 1 to 4 cm, 1 to 3 cm, 1.5 to 5 cm, 1.5 to 4 cm, or 1.5 to 3 cm.

By uniting the connection to the underside of the sink together with the trap structure and outlet as a single integral unit, completed by removable lower cover 32, and by creating an overlap of the outlet with the drain receptacle, the apparatus of the present invention typically achieves space-saving compactness, a reduced number of components and a reduced number of connections, thereby typically resulting in cost savings in production and installation, as well as improved reliability. These and other features, and advantages, of the present invention will become clearer from the detailed description of the various preferred embodiments.

Specifically, the total height of apparatus 10, indicated by $h_{total}$ in FIG. 1D, is at most 20 centimeters, at most 18 centimeters, or at most 15 centimeters. In some embodiments, the total height of the apparatus 10 is in the range of 12-20 cm, 14-20 cm, 15-20 cm, 12-18 cm, 13-18 cm, 14-18 cm, 12-17 cm, 13-17 cm, 14-17 cm, 15-17 cm, 12-16 cm, 13-16 cm, or 14-16 cm. In most particularly preferred implementations of the present invention, the unitary body terminates at a lower opening 34 which is sealed by attachment of lower cover 32, which is preferably achieved by threaded interconnection. Thus, in the embodiments illustrated here, the unitary body has an external threaded region 36 while lower cover 32 has a complementary inner threaded region 38 within its rim. Other arrangements, such as with internal threading on the main body and external threading on lower cover 32, may also be used. Other forms of engagement, such as bayonet connections and/or various arrangements of external clasps or the like, also fall within the scope of the present invention.

In some embodiments, lower cover 32 has a depth, indicated by $h_c$ in FIG. 1D, so as to increase the total height of the apparatus by 1 to 5 cm, 1 to 4 cm, 1.5 to 5 cm, 1.5 to 4 cm, 1.5 to 3 cm, 2 to 5 cm, 2 to 4 cm, 2 to 3.5 cm, or 2 to 3 cm.

The provision of an easily-removable lower cover for the trap provides convenient access for unskilled persons for periodic cleaning of the trap and/or for recovery of any high-density object, such as jewelry, which may accidentally be dropped or flushed down a drain, without requiring particular skill or specialized tools.

Another particularly preferred set of features of certain implementations of the present invention relates to features defining a volume at and/or below the drain opening of the sink for collecting waste from the sink. Such an arrangement is included in various drain configurations for kitchen sinks, often with a removable strainer 40, referred to as a "basket strainer", allowing periodic removal of the strainer to empty out the waste. To this end, first wall portion 16 may preferably be implemented as a cylindrical wall portion circumscribing upper drain volume 18, and having a cross-sectional area greater than an internal cross-sectional area of each of down-flow conduit 20 and up-flow conduit 24 adjacent to lip 28. Upper drain volume 18 thus provides sufficient volume for accommodating a removable basket strainer 40 for waste collection. A typical inner diameter of first wall portion 16 and of the drain receptacle, indicated by $D_t$ in FIG. 1D, is at least 7 cm, and typically within the range of 7-15 cm, 8-15 cm, or 8-12 cm. Similarly, the drain receptacle defined by first wall portion 16 preferably circumscribes upper drain volume 18 so as to provide an unobstructed depth, or height $h_r$ of at least 2 centimeters, and more preferably, between about 4 and about 10 centimeters, extending downwards from abutment surface 14 for receiving a removable basket strainer for waste collection.

In some embodiments, the diameter $D_c$ of lower cover 32 is substantially equal to the diameter $D_t$ of the top opening of the drain receptacle, and a circumference of the lower cover 32 is substantially equal to the circumference of the top opening of the drain receptacle. In some such embodiments, the lower cover 32 is not concentric with the top opening of the drain receptacle, such that the lower cover 32 is offset relative to the wall portion 16 and to the drain receptacle.

In some embodiments, a length of the offset between the drain receptacle and the lower cover, indicated by $L_{offset}$ in FIG. 1D, is at least 1 cm, at least 2 cm, at least 3 cm, or at least 4 cm.

In some embodiments, the offset length ($L_{offset}$) is within a range of 1-10 cm, 1-8 cm, 1-6 cm, 2-10 cm, 2-8 cm, 2-6 cm, 3-10 cm, 3-8 cm, 3-6 cm, 4-10 cm, 4-8 cm, or 4-6 cm.

In the context of the present invention, the term "A is offset relative to B" is defined as the footprint of A not fully overlapping, or being fully coincident with, the footprint of B. Stated differently, there is a portion of the footprint of A that is not included in the footprint of B, and there is a portion of the footprint of B that is not included in the footprint of A.

It should be noted that first wall portion 16 circumscribes the drain volume 18, but does not typically come directly in contact with basket strainer 40, since the assembly of the apparatus to a sink typically includes an upper drain cup 42 (best seen in FIGS. 1A, 2A and 2B), inserted from above the base of the sink, which serves as an inner liner to first wall portion 16 when assembled.

Various arrangements may be used within the scope of the present invention for clamping the apparatus to a sink. According to one particularly preferred but non-limiting option, corresponding to the solution illustrated in most of the embodiments described herein, the apparatus includes a clamping block 44 with a threaded aperture 46 supported at the base of upper drain volume 18 for bolted attachment to upper drain cup 42. Clamping block 44 is typically supported by a number of spaced-apart fins 48 that leave openings for the passage of water from upper drain volume 18 to down-flow conduit 20. FIG. 2A illustrates an assembled configuration in which a bolt 50 tightens upper drain cup 42 towards clamping block 44, thereby closing an outer flange of upper drain cup 42 against an upper internal surface of sink 52 and drawing the apparatus upwards so that abutment surface 14 presses against the underside of sink 52 around the drain opening, preferably via a sealing washer or bead of sealant 54 disposed in seat 15.

Optionally, one design of apparatus 10 may accommodate upper drain cups of different depths or sizes. By way of example, FIG. 2B illustrates an assembly similar to that of FIG. 2A employing a relatively shallower upper drain cup 42'. The shallower upper drain cup could be clamped directly to clamping block 44 simply by using a correspondingly longer bolt. As an alternative, FIG. 2B illustrates the use of a clamping block adapter 56, shown in isometric view in FIG. 2C, which combines a male threaded portion 58 for engaging threaded aperture 46 and a threaded aperture 60 for bolted attachment to shallow upper drain cup 42' by use of a bolt 50.

In certain preferred embodiments of the present invention, such as in apparatus 10, 200, 300 and 700, down-flow conduit 20 and up-flow conduit 24 are in side-by-side relation, with part of second wall portion 22, or third wall portion 26, defining a partition between down-flow conduit 20 and up-flow conduit 24. The definition of the partition as part of second wall portion 22 or third wall portion 26 may be somewhat arbitrary, as the partition is essentially a shared wall subdividing between the two conduits, and is integrally formed with the other wall portions. In the case of apparatus 10 and 200, the partition is curved, with its concave side facing towards outlet 30, thereby leaving a majority of a generally cylindrical lower section of the apparatus to define a volume contiguous with down-flow conduit 20. This arrangement is particularly useful for accommodating additional inlets into the trap, such as single supplementary inlet 62 of apparatus 10, or the two supplementary inlets 262*a* and 262*b* of apparatus 200. These supplementary inlets may be used for drain connections for various kitchen appliances, such as a dishwasher, for sink overflow connections and/or may allow for connection of one or more additional sink drains (with conventional drain configurations) to the trap of the apparatus of the invention, for example, in a double sink installation. In some cases, for double sink installations, it may be preferable to install two apparatuses according to the present invention, one for each sink, and then simply connect the outlets via a T-connector or the like to a common wastewater drain system. It will be noted that there may be any desired number of supplementary inlets, and that each inlet may be implemented in any desired configuration in order to accommodate specific design needs. Thus, in one further non-limiting example, an apparatus (not shown) similar to apparatus 200 maybe implemented with a dedicated overflow inlet, typically connecting directly to upper drain volume 18, a dedicated hose connector (for example, with a ribbed, conically tapered tip for pressure-fitting of a hose) for a dishwasher or the like, and one or two additional inlets for adjacent sinks or the like. Any inlets that are not required for a given installation may be sealed with a suitable stopper.

In each case where one or more supplementary inlet is provided, the inlet is preferably located above lip 28 by a differential height sufficient to maintain the gas trap functionality, and most preferably, maintains a height differential of at least $h_d$ (FIG. 1D) corresponding to the height differential between outlet 30 and lip 28. It should be noted that the term "height differential" in this context is used to define the height of the head of water caught in the trap, from lip 28 up to the lowest part of the opening of outlet 30 (and similarly with regard to supplementary inlet 62).

Figure 3:
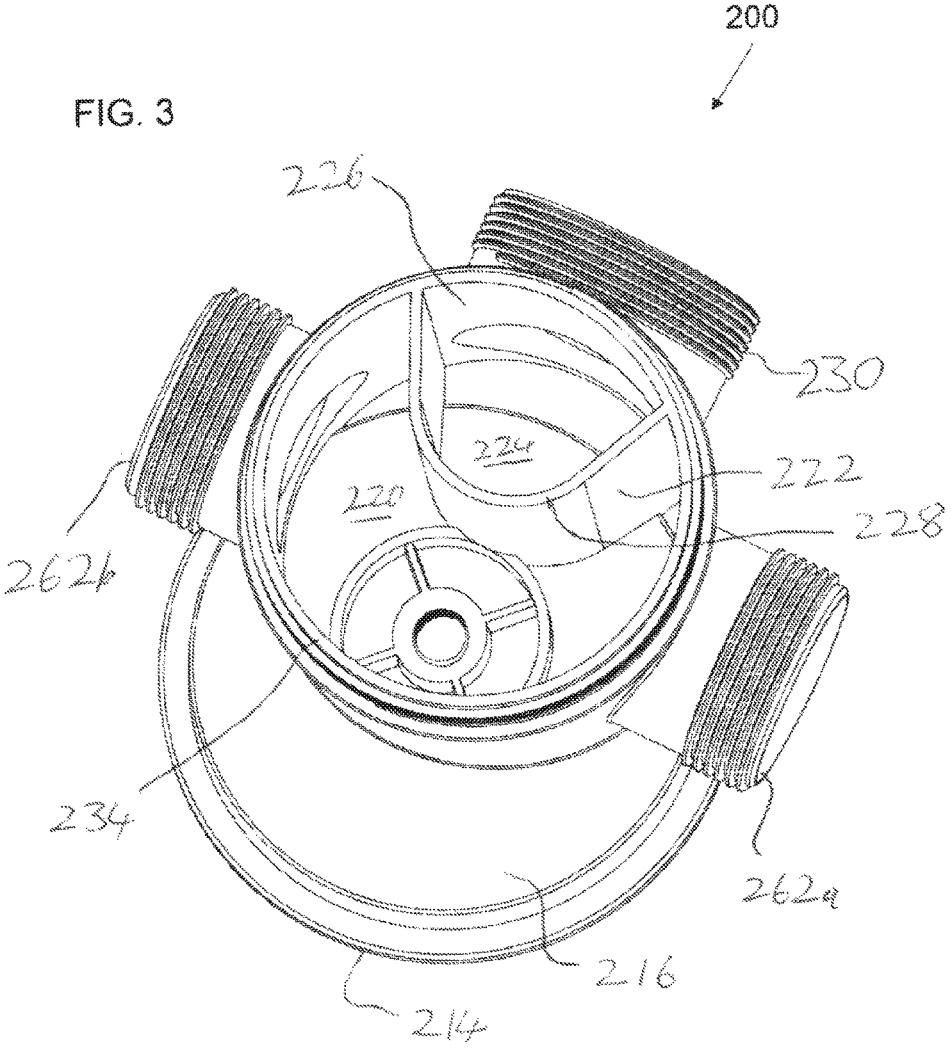
FIG. 3 is a lower isometric view of the unitary body from a variant implementation of the apparatus of FIG. 1A.
Figure 4A:
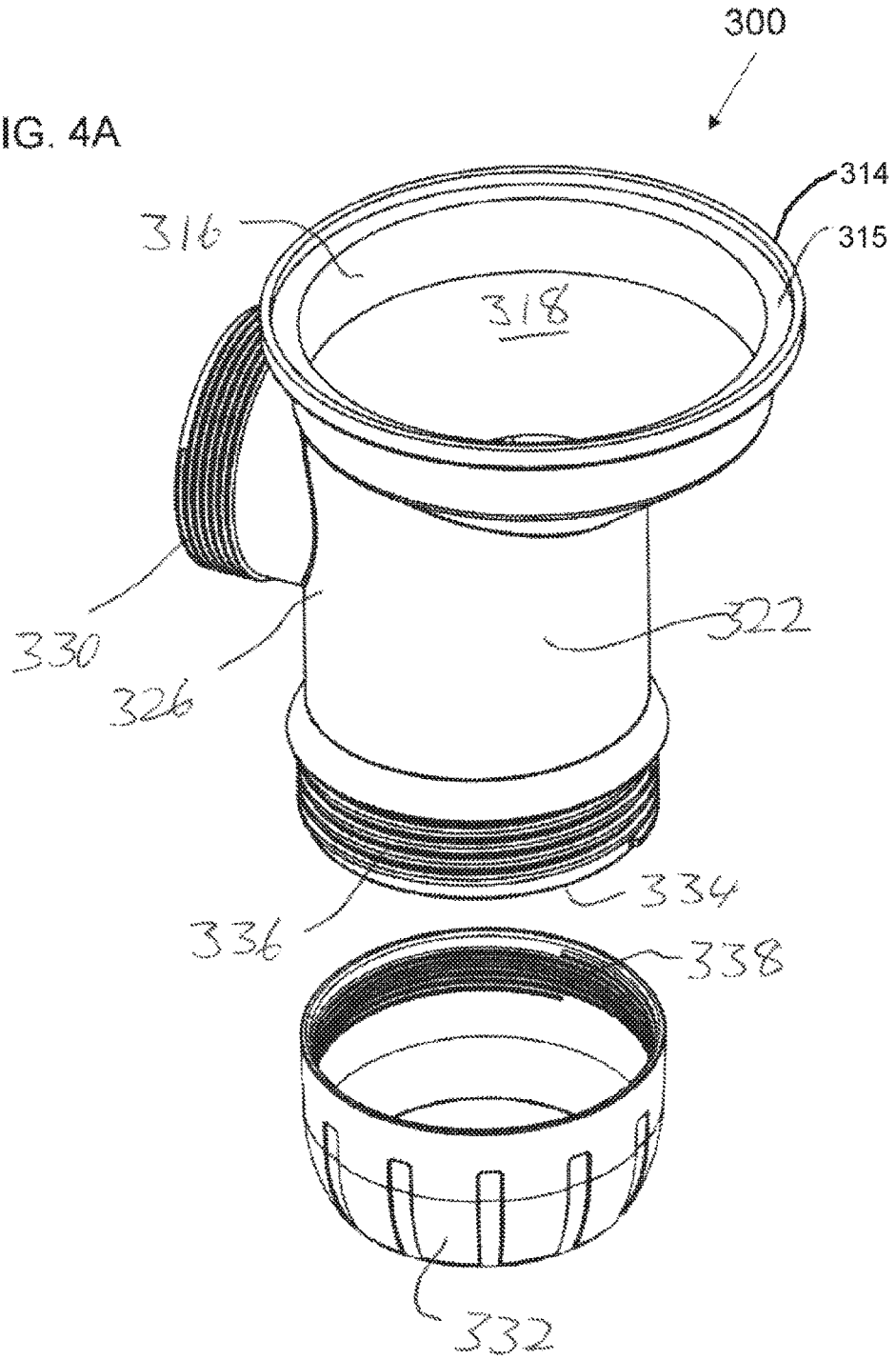
FIG. 4A is an exploded isometric view of a sink drain apparatus, constructed and operative according to a further embodiment of the present invention.
Figure 4B:
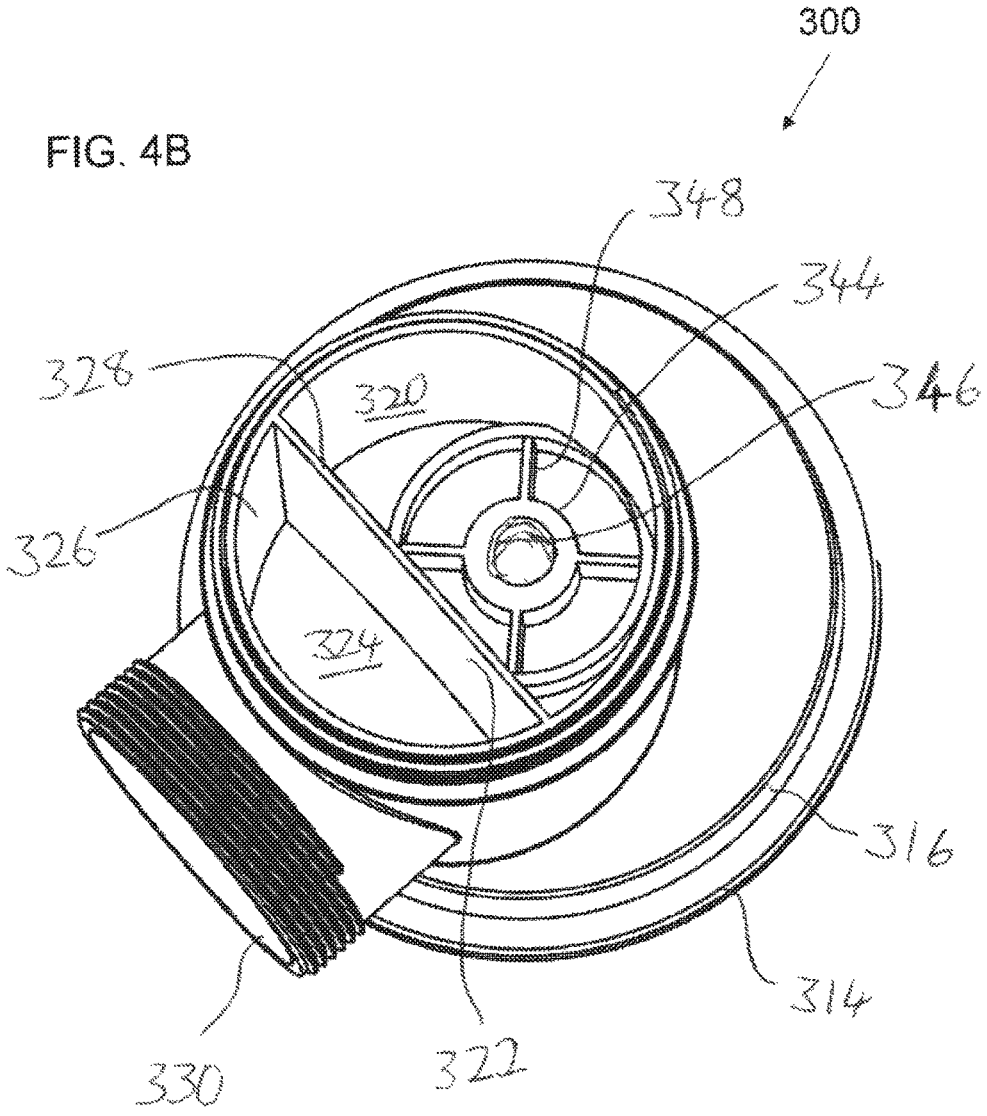
FIG. 4B is a lower isometric view of the unitary body from the apparatus of FIG. 4A.
Figure 4C:
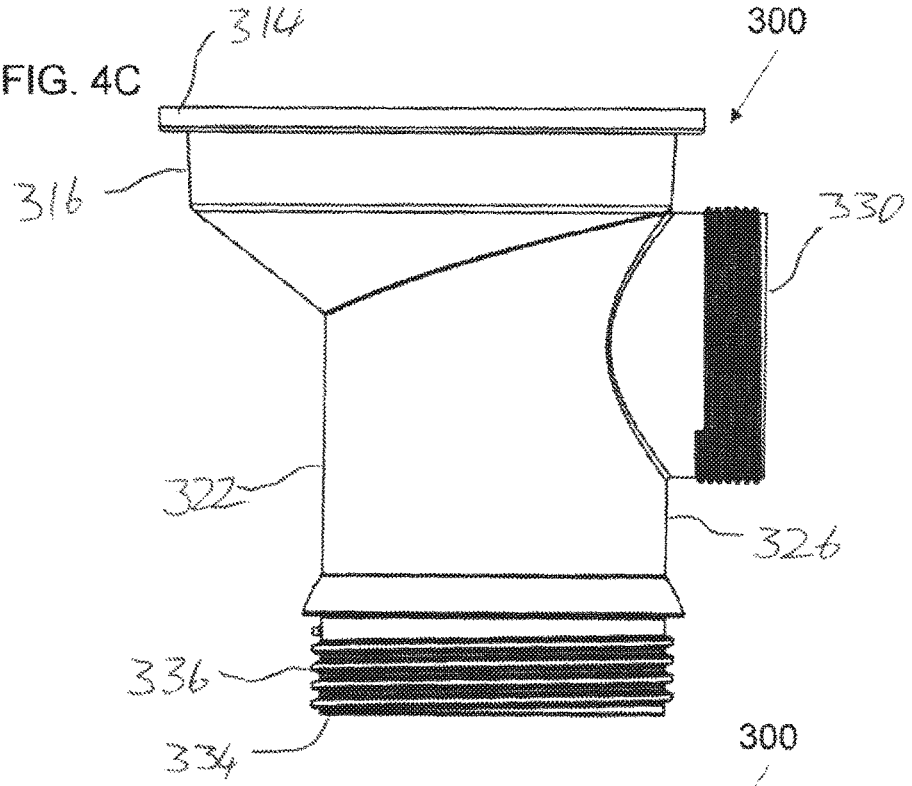
FIG. 4C is a side view of the unitary body from the apparatus of FIG. 4A.
Figure 4D:
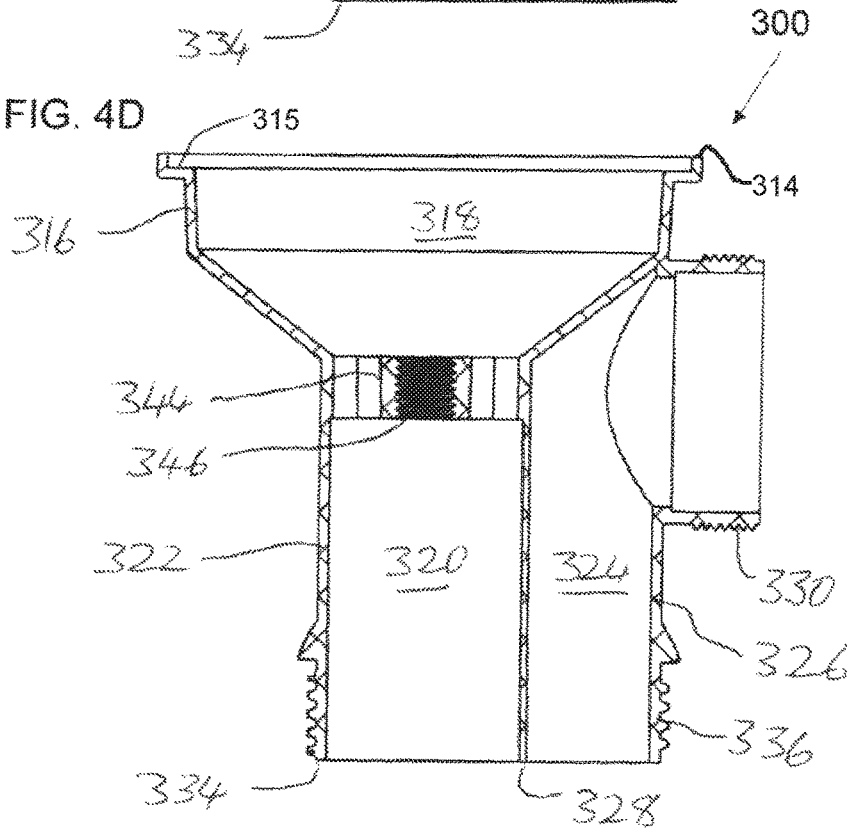
FIG. 4D is a vertical cross-sectional view taken through the unitary body from the apparatus of FIG. 4A.

Turning now to FIG. 3, this depicts apparatus 200, which is essentially similar to apparatus 10 described above, with equivalent features designated by similar numerals with addition of 200. Only the unitary body is shown here. Apparatus 200 is fully analogous to apparatus 10, differing only in the provision of two supplementary inlets 262*a* and 262*b*. In all other respects, the structure and function of apparatus 200 will be fully understood from the generic description above.

Turning now to FIGS. 4A-4D, these depict apparatus 300, which is essentially similar to apparatus 10 described above, with equivalent features designated by similar numerals with addition of 300. Apparatus 300 is fully analogous to apparatus 10, but is implemented without any supplementary inlet, allowing a particularly compact lower structure. The part of second wall portion 322 providing the partition between down-flow conduit 320 and up-flow conduit 324 is here implemented as a roughly straight wall. In all other respects, the structure and function of apparatus 300 will be fully understood from the generic description above.

Figure 5A:
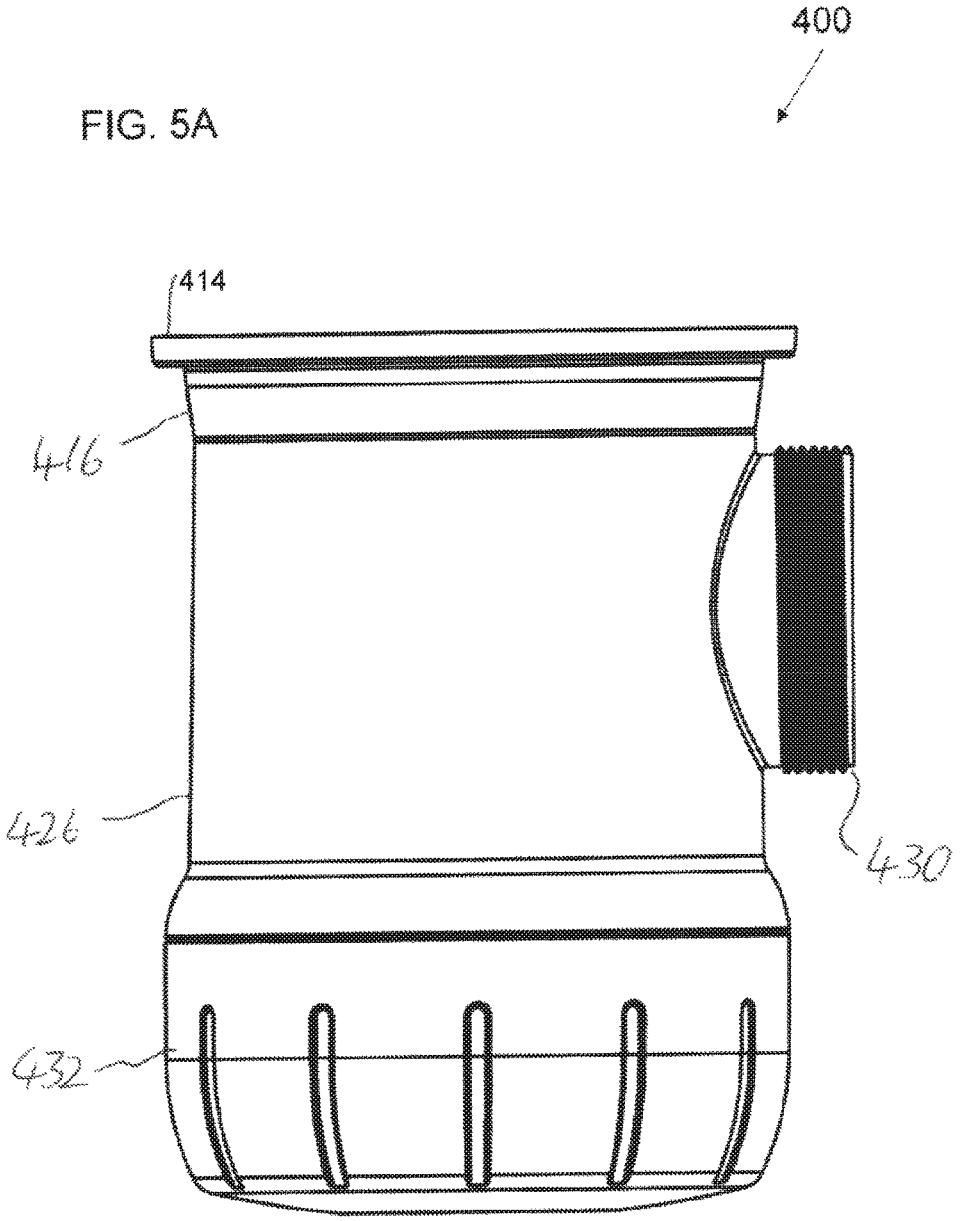
FIG. 5A is a side view of a sink drain apparatus, constructed and operative according to a further embodiment of the present invention.
Figure 5B:
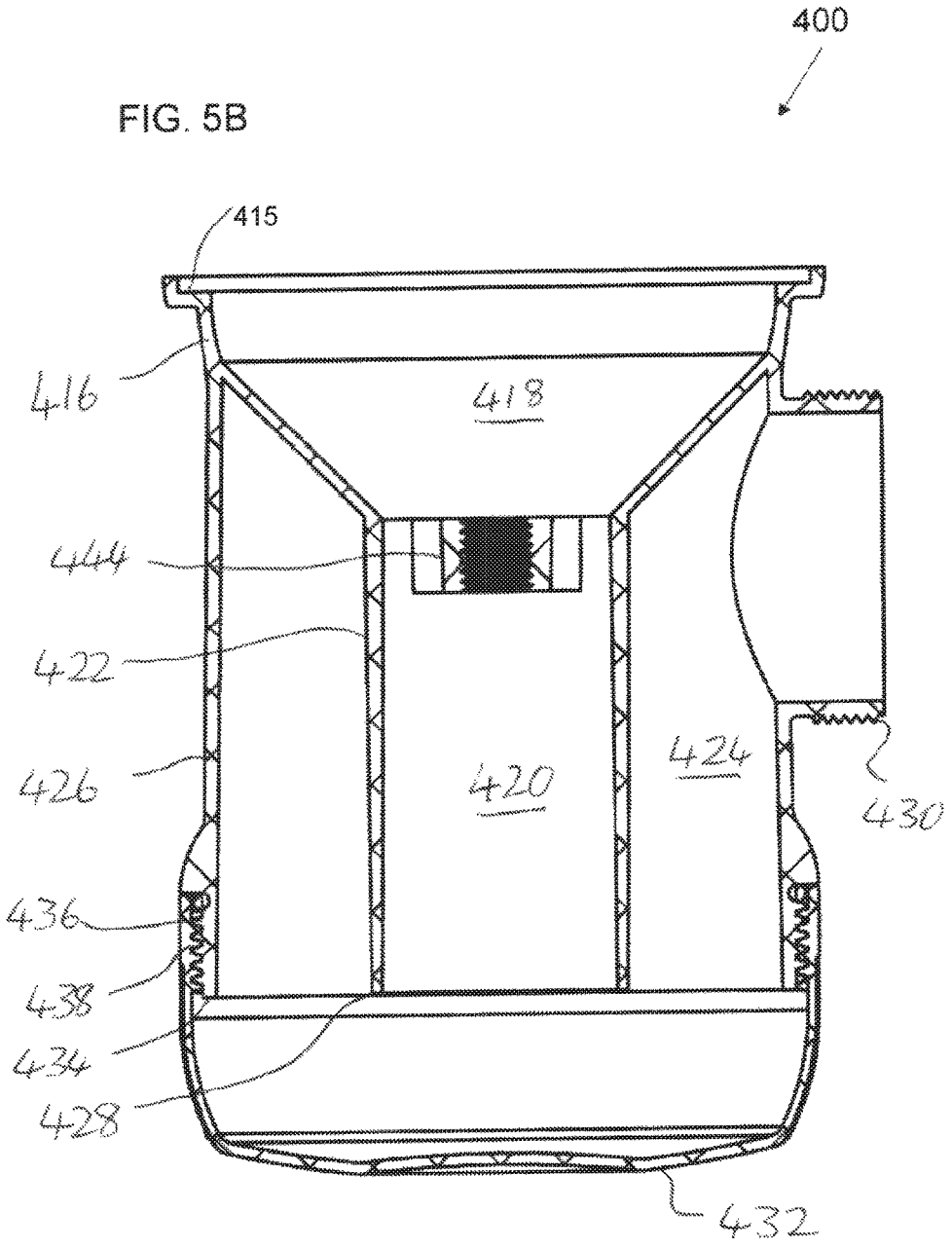
FIG. 5B is a vertical cross-sectional view taken through the apparatus of FIG. 5A.

Turning now to FIGS. 5A and 5B, these depict apparatus 400, which is essentially similar to apparatus 10 described above, with equivalent features designated by similar numerals with addition of 400. Apparatus 400 differs from apparatus 10 in that it employs an arrangement in which down-flow conduit 420 is implemented as an internal pipe defined by an inner second wall portion 422 forming a roughly-cylindrical conduit circumscribed by up-flow conduit 424 defined by an outer wall 426. The resulting structure is roughly concentric, maintaining a roughly cylindrical symmetry below the sink drain opening, which may in some cases be advantageous. In all other respects, the structure and function of apparatus 400 will be fully understood from the generic description above.

Figure 7:
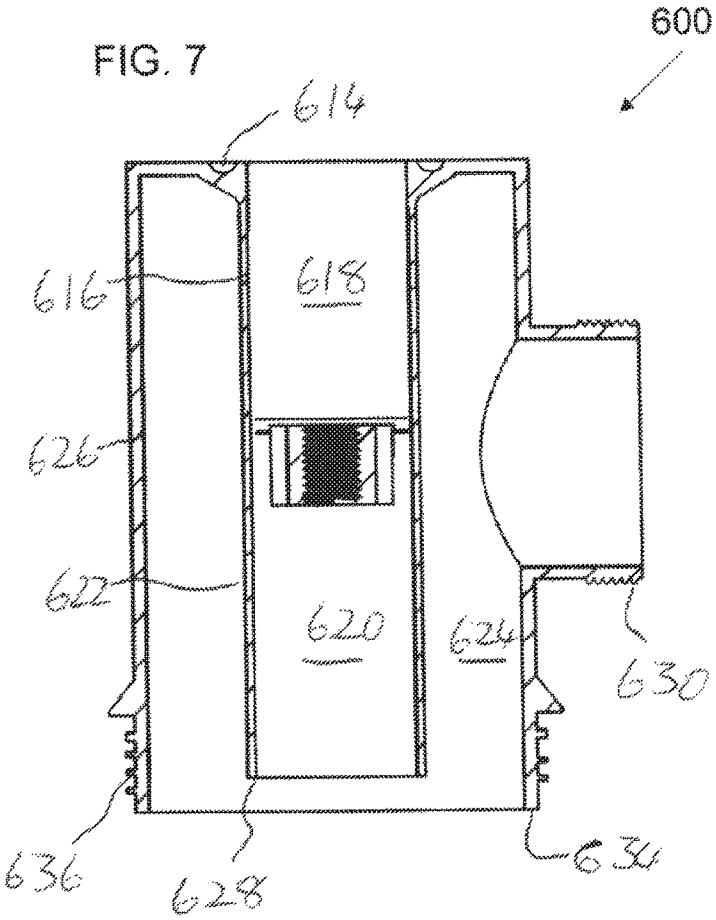
FIG. 7 is a vertical cross-sectional view taken through the unitary body of a further variant implementation of the apparatus of FIG. 5A.
Figure 6:
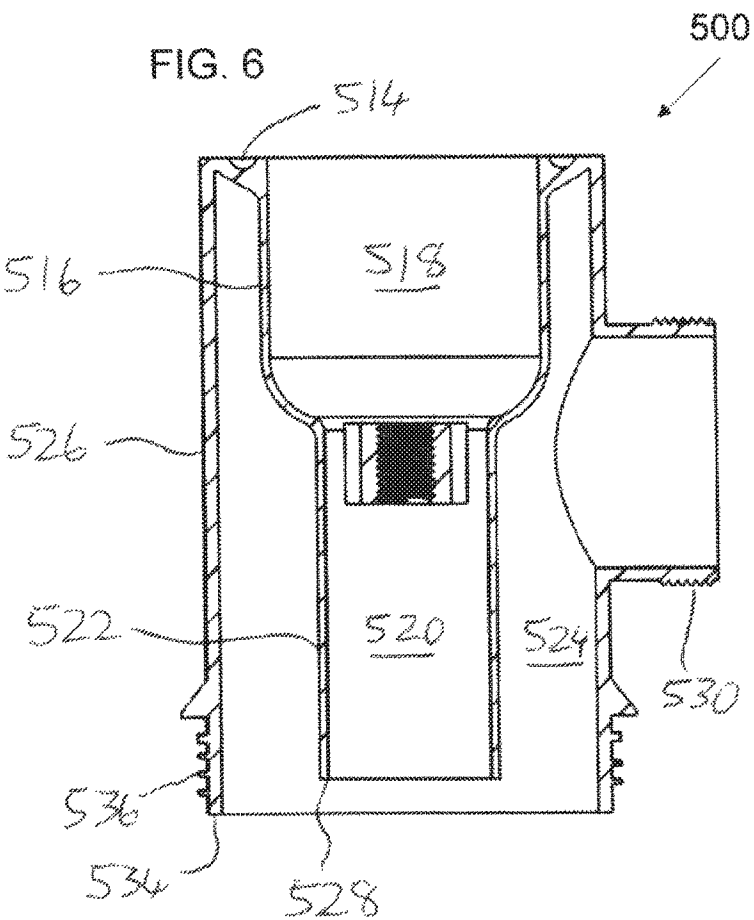
FIG. 6 is a vertical cross-sectional view taken through the unitary body of a variant implementation of the apparatus of FIG. 5A.
Figure 8:
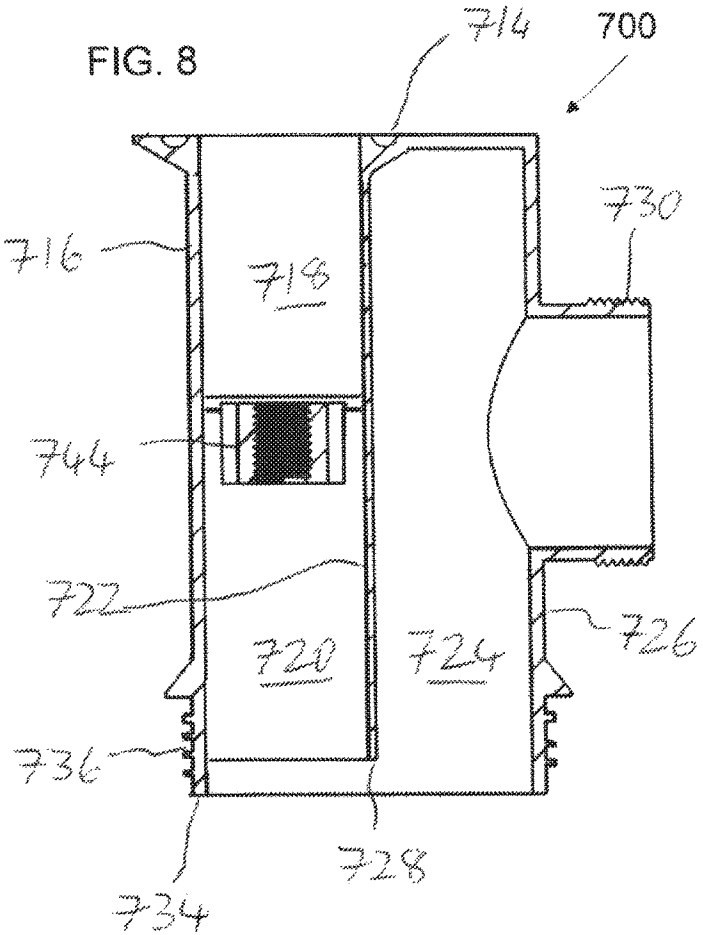
FIG. 8 is a vertical cross-sectional view taken through the unitary body of a sink drain apparatus, constructed and operative according to a further embodiment of the present invention.

FIGS. 6-8 illustrate apparatuses 500, 600 and 700, respectively, which are essentially similar to earlier described implementations, differing only in the geometrical shapes and proportions. Specifically, apparatus 500 is closely similar to apparatus 400 but exemplifies an implementation in which upper drain volume 518 is relatively narrow and deep, with a depth at least equal to its diameter. Apparatus 600 has an even narrower upper drain volume 618 such that first wall portion 616 and second wall portion 622 are essentially successive sections of a cylindrical tube. These narrower implementations may be particularly suited to sinks with narrow drain openings, such as for example in bathroom sinks. Apparatus 700 is functionally interchangeable with apparatus 600 in that it provides a narrow upper drain volume 718, but it employs a side-by-side arrangement of down-flow conduit 720 and up-flow conduit 724, more similar to apparatus 400 above.

Figure 9:
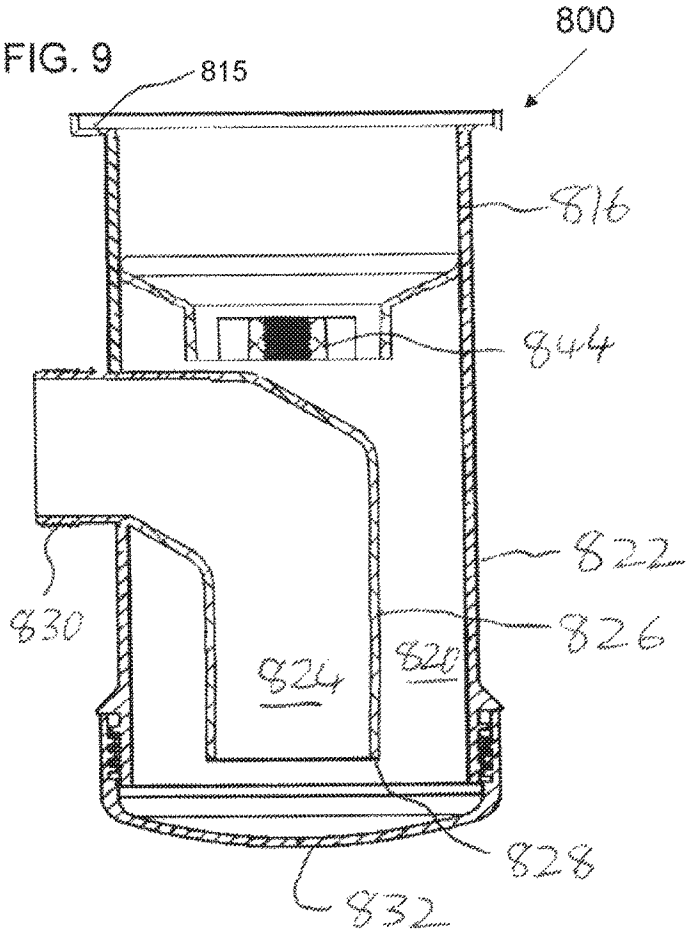
FIG. 9 is a vertical cross-sectional view taken through a sink drain apparatus, constructed and operative according to a further embodiment of the present invention.

Turning now to FIG. 9, this depicts apparatus 800, which is similar to apparatus 10 described above, with equivalent features designated by similar numerals with addition of 800. Only the unitary body is shown here, to be complemented by a lower removable cover, upper drain cup etc., as in the other embodiments. In the previously illustrated "concentric" structures, such as apparatus 400, the down-flow conduit was internal to the up-flow conduit. Apparatus 800 illustrates an alternative implementation in which up-flow conduit 824 is implemented as an internal conduit circumscribed by down-flow conduit 820. In all other respects, the structure and function of apparatus 800 will be fully understood from the generic description above.

Figure 10A:
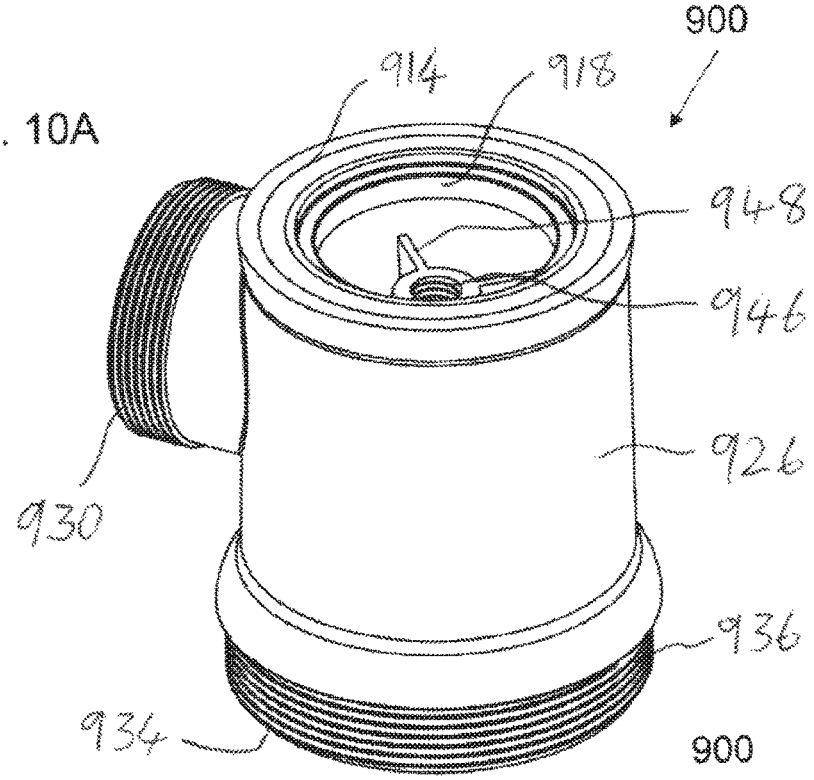
FIG. 10A is an isometric view of a sink drain apparatus, constructed and operative according to a further embodiment of the present invention.
Figure 10B:
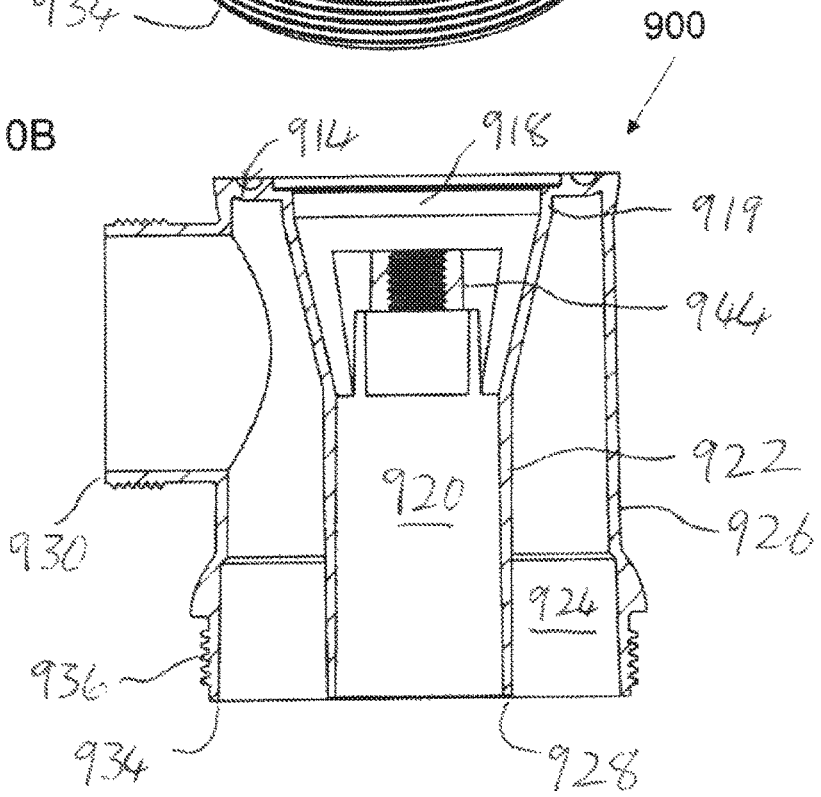
FIG. 10B is a vertical cross-sectional view taken through the unitary body from the apparatus of FIG. 10A.

Turning now to FIGS. 10A-10B, this depicts apparatus 900, which is similar to apparatus 10 described above, with equivalent features designated by similar numerals with addition of 900. Only the unitary body is shown here, to be complemented by a lower removable cover, upper drain cup etc., as in the other embodiments. While the various implementations illustrated thus far have provided a sizeable upper drain volume suitable for receiving a basket strainer or the like, it should be noted that implementations of the invention with a minimal upper drain volume sufficient only for receiving a standard drain cover, without a distinct waste receiving volume, also fall within the scope of an aspect of the present invention. This is exemplified by apparatus 900, in which a shallow upper drain volume 918 is defined between abutment surface 914 and clamping block 944. The integration of the abutment surface with the wall portions forming down-flow conduit 920, up-flow conduit 924 and outlet 930 still provides profound advantages of compactness, ease of assembly, reduced number of parts etc., while the provision of a removable lower cover (not shown) provides convenient access for unskilled persons for periodic cleaning of the trap and/or for recovery of any high-density object, as discussed above.

Figure 11A:
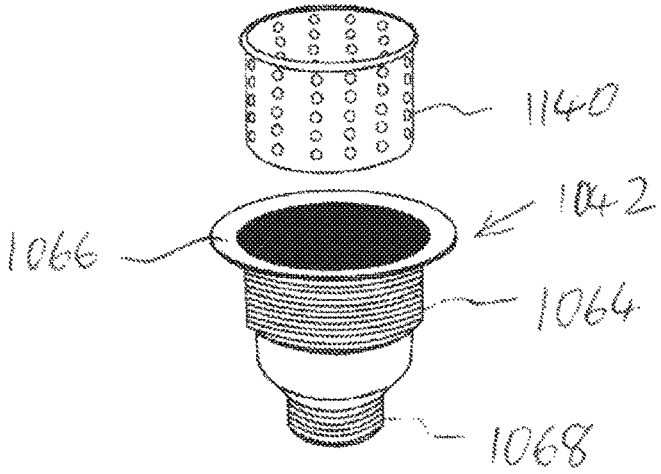
FIG. 11A is an exploded isometric view of an alternative type of sink drain cup and bucket strainer for use with an embodiment of the present invention.
Figure 11B:
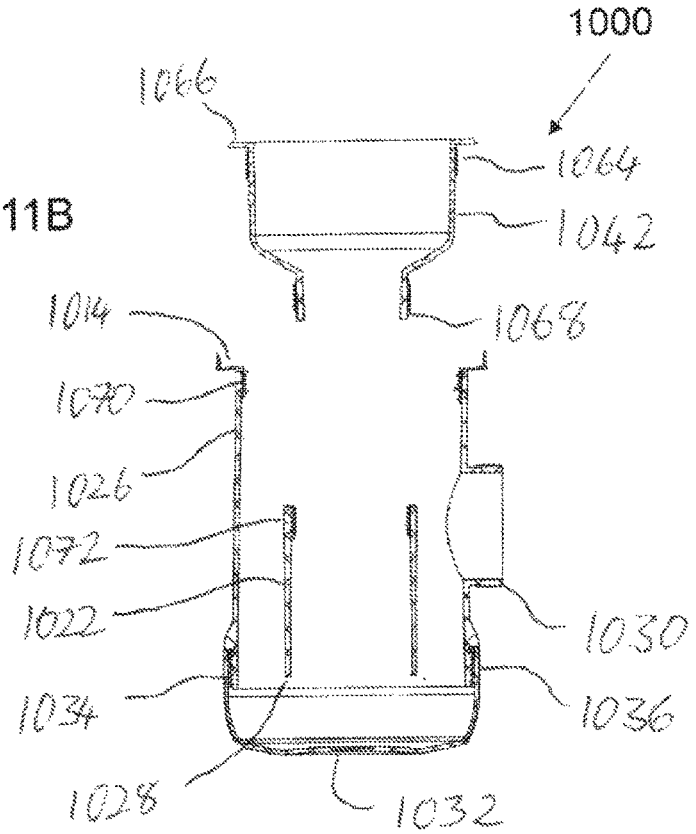
FIG. 11B is a vertical cross-sectional view taken through a sink drain apparatus, constructed and operative according to a further embodiment of the present invention, for use with the sink drain cup of FIG. 11A.
Figure 11C:
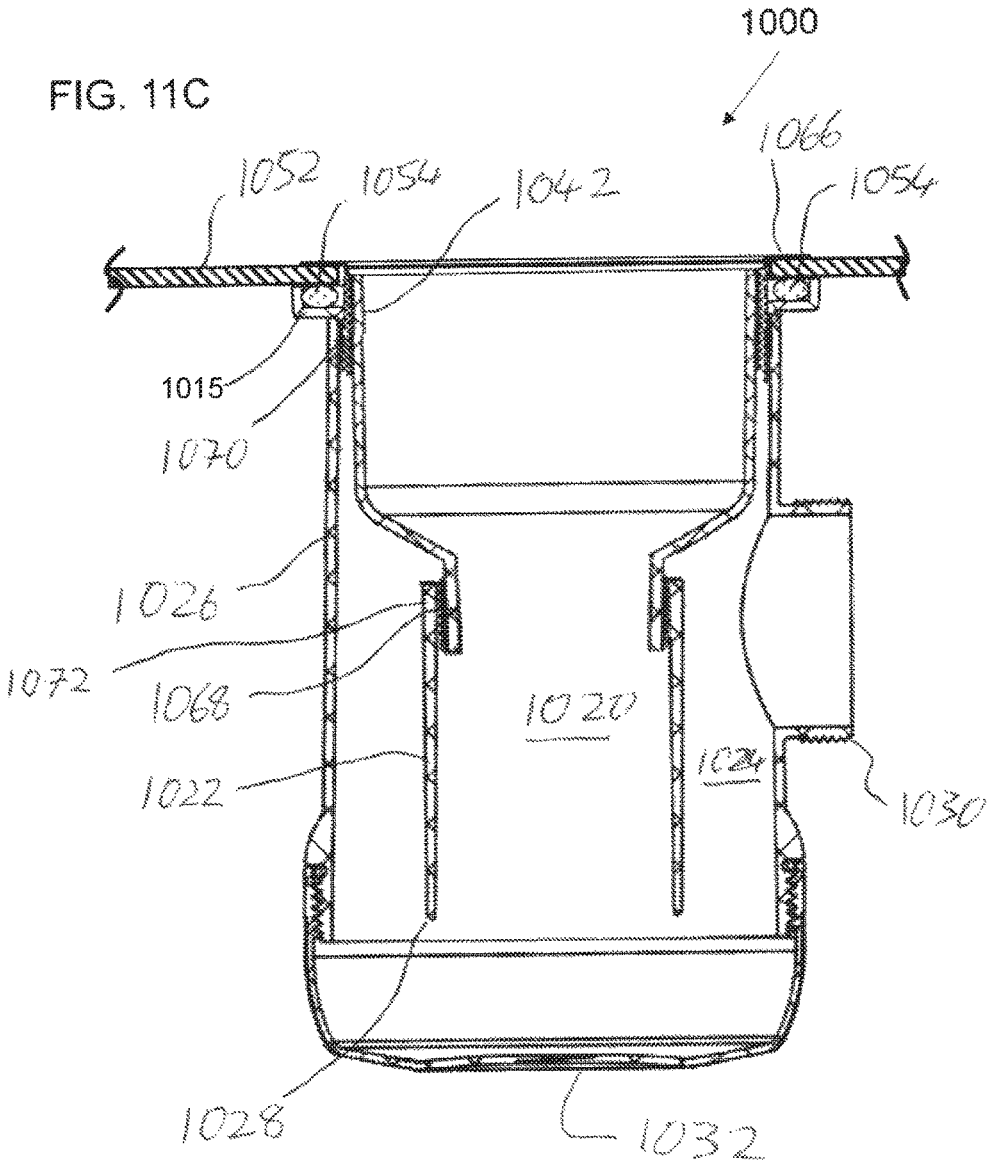
FIG. 11C is a cross-sectional view similar to FIG. 11B showing the apparatus assembled to the drain aperture of a sink.
Figure 12:
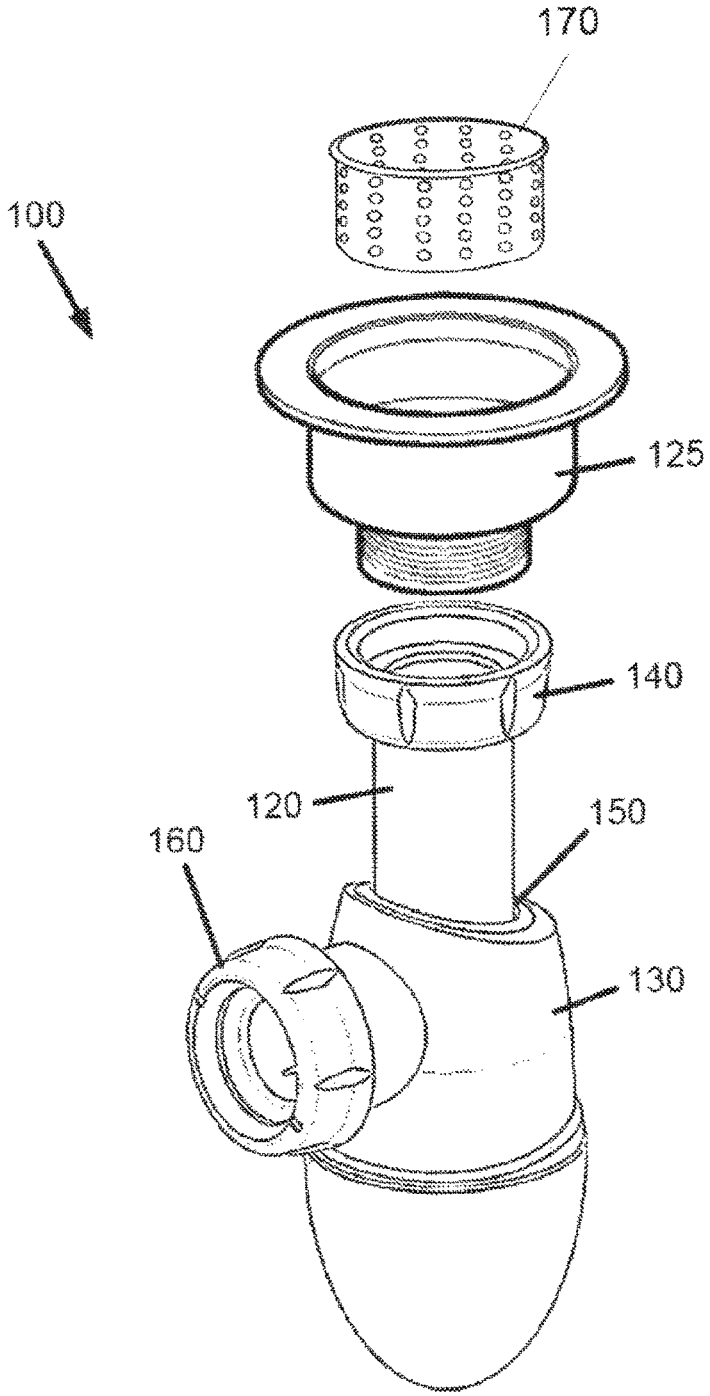
FIG. 12 (PRIOR ART)
FIG. 12 (described above) is an isometric view of a conventional under-sink assembly including a drain cup, tailpiece and bottle trap.

Turning finally to FIGS. 11A-11C, this depicts apparatus 1000, which is similar to apparatus 10 described above, with equivalent features designated by similar numerals with addition of 1000. All of the implementations illustrated above have been configured for attachment to a sink drain aperture by use of a central bolt which clamps together the unitary body and an upper drain cup. It should be noted however that the present invention is not limited to this form of attachment, and may also be implemented using various other forms of attachment to a sink. By way of one further non-limiting example, FIG. 11A illustrates an alternative form of drain cup 1042 which has external threading 1064 around an outer diameter of the drain cup, extending downwards from an upper radial flange 1066. In conventional applications, such a cup is inserted from above through a sink drain aperture, and a threaded clamping ring/nut is screwed onto threading 1064 from below the sink, tightening and clamping the drain cup to the aperture. In conventional applications, a tailpiece is then connected to a smaller-gauge lower opening 1068 of the drain cup.

According to the teachings of an aspect of the present invention illustrated in FIGS. 11B and 11C, the part of an outer wall portion 1026 adjacent to abutment surface 1014 is formed with internal threading 1070 for engaging threading 1064 so that wall portion 1026 can be directly screwed onto drain cup 1042 to achieve clamping of the apparatus to sink 1052, as shown in FIG. 11C.

Wall portion 1026 extends downwards to a rim 1034, which defines a lower opening that sealingly receives removable lower cover 1032. The apparatus is provided with an outlet 1030. In this case, as in the above implementations, abutment surface 1014, a wall portion 1026, rim 1034 and outlet 1030 are integrally formed as a unitary body. Furthermore, and also as in apparatus 400 above, when assembled, wall portion 1026 and removable lower cover 1032 form at least part of an outer casing of a bottle trap preventing passage of gases from outlet 1030 to the drain aperture.

In contrast to the above embodiments, the wall portion 1022 defining an inner down-flow conduit 1020 is here implemented as a separate component with its own threaded neck portion 1072 for threaded connection to lower opening 1068 of drain cup 1042. This adds one additional component to the system, but still maintains the overall compactness and simplicity of the device. In some cases, a dedicated drain cup design 1042 may be integrally formed with a tailpiece 1022, thereby reducing the total number of components in the assembly.

The various embodiments described herein may be implemented using a wide range of materials. Most typically, the unitary body and the lower cover are formed from injection-molded plastic materials, while the upper drain cup if formed from metal, for example, aluminum or stainless steel. However, the invention is not limited to such implementations, and alternative implementations made wholly from plastic materials, wholly from metal, or from any other material, also fall within the scope of the invention.

To the extent that the appended claims have been drafted without multiple dependencies, this has been done only to accommodate formal requirements in jurisdictions which do not allow such multiple dependencies. It should be noted that all possible combinations of features which would be implied by rendering the claims multiply dependent are explicitly envisaged and should be considered part of the invention.

It will be appreciated that the above descriptions are intended only to serve as examples, and that many other embodiments are possible within the scope of the present invention as defined in the appended claims.

What is claimed is:

1. A monolithic drain apparatus for connection to a drain aperture of a sink, the drain apparatus comprising:

a drain receptacle including a top opening adapted to align with the drain aperture of the sink, the top opening having a first diameter ($D_t$) defining a first cross sectional area, a bottom opening enabling fluid to drain from said drain receptacle, said bottom opening having a second diameter ($D_b$) defining a second cross-sectional area, said drain receptacle defining a drain volume ($V_{drain}$);

a drain apparatus housing connected to said drain receptacle, including:

a down-flow conduit extending from said drain receptacle in alignment with said bottom opening and having a down-flow conduit circumference, said down-flow conduit defining a down-flow-path in fluid communication with said drain volume; and an up-flow conduit, extending alongside said down-flow conduit and defining an up-flow-path; and a partition separating said down-flow conduit from said up-flow conduit;

an outlet drain pipe extending from said drain apparatus housing at a terminus of said up-flow conduit and defining an outlet-flow-path in fluid communication with said up-flow-path; and a reversibly removable lower cover configured to sealingly engage said drain apparatus housing, so as to complete a sealed flow path from said drain volume, via said down-flow-path, to said up-flow-path conduit and said outlet-flow-path, wherein a height differential ($h_d$) between a bottom of an interior wall of said outlet drain pipe and a bottom edge of said partition defines a gas trap, with $h_d$ being greater than 0, wherein a cross-sectional area of said down-flow conduit is at least 80% of said second cross-sectional area along the entire length of said down-flow conduit, wherein said drain receptacle, said drain apparatus housing including said partition, and said outlet drain pipe, are monolithic, wherein a portion of said outlet drain pipe is disposed above said bottom opening of said drain receptacle by a height $h_o$, wherein $h_o$ is greater than 0, and wherein said removable lower cover is offset relative to said drain receptacle, and wherein a total height ($h_{total}$) of said drain apparatus, including said reversibly removable lower cover, is at most 20 cm.

2. The monolithic drain apparatus of claim 1, wherein a wall portion of said drain receptacle is a cylinder, and wherein said portion of said outlet drain pipe is disposed above a bottom of said cylinder, by a height $h_{oc}$, wherein $h_{oc}$ is greater than 0.

3. The monolithic drain apparatus of claim 2, wherein a height of said cylinder is at least 4 cm.

4. The monolithic drain apparatus of claim 1, wherein said drain receptacle has a depth ($h_r$) in the range of 4-10 cm.

5. The monolithic drain apparatus of claim 1, wherein $h_o$ is within a range of 1-7 cm.

6. The monolithic drain apparatus of claim 1, wherein, above said bottom edge of said partition said partition completely seals between said up-flow-path and said down-flow-path.

7. The monolithic drain apparatus of claim 1, wherein a length of said offset ($L_{offset}$) is within a range of 1-4 cm.

8. The monolithic drain apparatus of claim 1, further comprising an abutment surface, circumscribing said top opening of said drain receptacle, adapted to abut a surface of the sink surrounding the drain aperture.

9. The monolithic drain apparatus of claim 1, further comprising an inlet defining an inlet-flow-path, said inlet-flow-path being in fluid communication with said down-flow-path, said inlet being disposed at least partially above said trap and being monolithic with said drain apparatus housing.

10. The monolithic drain apparatus of claim 1, wherein a total height ($h_{total}$) of said drain apparatus, including said reversibly removable lower cover, is within the range of 13 to 18 cm.

11. The monolithic drain apparatus of claim 1, wherein a diameter of said top opening of said drain receptacle is in a range of 7-15 cm.

12. The monolithic drain apparatus of claim 1, wherein said removable lower cover has a depth ($h_c$) so as to increase said total height of the apparatus by 1-5 cm.

13. A monolithic drain apparatus for connection to a drain aperture of a sink, the drain apparatus comprising:

a drain receptacle including a top opening adapted to align with the drain aperture of the sink, the top opening having a first diameter ($D_t$) defining a first cross sectional area, a bottom opening enabling fluid to drain from said drain receptacle, said bottom opening having a second diameter ($D_b$) defining a second cross-sectional area, said drain receptacle defining a drain volume ($V_{drain}$);

a drain apparatus housing connected to said drain receptacle, including:

a down-flow conduit extending from said drain receptacle in alignment with said bottom opening and having a down-flow conduit circumference, said down-flow conduit defining a down-flow-path in fluid communication with said drain volume; and an up-flow conduit, extending alongside said down-flow conduit and defining an up-flow-path; and a partition separating said down-flow conduit from said up-flow conduit;

an outlet drain pipe extending from said drain apparatus housing at a terminus of said up-flow conduit and defining an outlet-flow-path in fluid communication with said up-flow-path; and a reversibly removable lower cover configured to sealingly engage said drain apparatus housing, so as to complete a sealed flow path from said drain volume, via said down-flow-path, to said up-flow-path conduit and said outlet-flow-path, wherein a height differential ($h_d$) between a bottom of an interior wall of said outlet drain pipe and a bottom edge of said partition defines a gas trap, with $h_d$ being greater than 0, wherein a cross-sectional area of said down-flow conduit is at least 80% of said second cross-sectional area along the entire length of said down-flow conduit, wherein said drain receptacle, said drain apparatus housing including said partition, and said outlet drain pipe, are monolithic, wherein a portion of said outlet drain pipe is disposed above said bottom opening of said drain receptacle by a height $h_o$, wherein $h_o$ is greater than 0.

14. The monolithic drain apparatus of claim 13, wherein a wall portion of said drain receptacle is a cylinder, and wherein said portion of said outlet drain pipe is disposed above a bottom of said cylinder, by a height $h_{oc}$, wherein $h_{oc}$ is greater than 0.

15. The monolithic drain apparatus of claim 13, wherein said drain receptacle has a depth of at least 4 cm.

16. The monolithic drain apparatus of claim 13, wherein $h_o$ is within a range of 1-7 cm.

17. The monolithic drain apparatus of claim 13, wherein, above said bottom edge of said partition said partition completely seals between said up-flow-path and said down-flow-path.

18. The monolithic drain apparatus of claim 13, wherein a total height ($h_{total}$) of said drain apparatus, including said reversibly removable lower cover, is at most 20 cm.

19. The monolithic drain apparatus of claim 13, wherein a total height of said drain apparatus, including said reversibly removable lower cover, is in the range of 13 to 18 cm.

20. The monolithic drain apparatus of claim 13, wherein a total height of said drain apparatus, including said reversibly removable lower cover, is in the range of 14 to 17 cm.

* * * * *